US006370900B1

(12) United States Patent
Maeda

(10) Patent No.: US 6,370,900 B1
(45) Date of Patent: Apr. 16, 2002

(54) DEHUMIDIFYING AIR-CONDITIONING APPARATUS AND DEHUMIDIFYING AIR-CONDITIONING SYSTEM

(75) Inventor: Kensaku Maeda, Tokyo (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 09/787,253

(22) PCT Filed: Sep. 16, 1999

(86) PCT No.: PCT/JP99/05040

§ 371 Date: Mar. 15, 2001

§ 102(e) Date: Mar. 15, 2001

(87) PCT Pub. No.: WO00/16016

PCT Pub. Date: Mar. 23, 2000

(30) Foreign Application Priority Data

Sep. 16, 1998 (JP) ..... 10-280529
Oct. 5, 1998 (JP) ..... 10-297623

(51) Int. Cl.[7] ..... F25D 23/00; F25D 17/06
(52) U.S. Cl. ..... 62/271; 62/94
(58) Field of Search ..... 62/271, 94, 238.6, 62/79, 333, 335, 238.3

(56) References Cited

U.S. PATENT DOCUMENTS 4,180,985 A * 1/1980 Northrup, Jr. ..... 62/94
4,887,437 A 12/1989 Fenton et al.
4,887,438 A 12/1989 Meckler
5,325,676 A 7/1994 Meckler
5,364,455 A 11/1994 Komarneni et al.
5,448,895 A 9/1995 Coellner et al.
5,718,122 A 2/1998 Maeda
5,758,509 A 6/1998 Maeda (List continued on next page.)

FOREIGN PATENT DOCUMENTS

JP 9-318099 12/1997
JP 10-26369 1/1998

OTHER PUBLICATIONS

U.S. Patent Appln. S.N. 09/381,802, dated Sep. 24, 1999.
U.S. Patent Appln. S.N. 09/402,647, dated Oct. 8, 1999.
U.S. Patent Appln. S.N. 09/402,644, dated Oct. 8, 1999.
U.S. Patent Appln. S.N. 09/402,656, dated Oct. 8, 1999.

*Primary Examiner*—Denise L. Esquivel
*Assistant Examiner*—Chen-Wen Jiang
(74) *Attorney, Agent, or Firm*—Armstrong, Westerman & Hattori, LLP

(57) ABSTRACT

It is an object of the present invention to provide a compact dehumidifying air-conditioning apparatus, and a dehumidifying air-conditioning apparatus and a dehumidifying air-conditioning system with reduced power consumed for delivering a heating medium or a chilling medium. The dehumidifying air-conditioning apparatus comprises a moisture adsorption device 103 having a desiccant for adsorbing moisture from process air, adsorbed moisture being desorbed by regeneration air; a first heat exchanger 120 for exchanging heat between the regeneration air and a heating medium, the first heat exchanger 120 being disposed upstream of the moisture adsorption device with respect to a flow of the regeneration air; a second heat exchanger 220 for exchanging heat between the process air and the heating medium, the second heat exchanger 220 being disposed downstream of the moisture adsorption device with respect to a flow of the process air; and a heating medium supply device HP for heating the heating medium supplied to the first heat exchanger 120 and the second heat exchanger 220. The dehumidifying air-conditioning apparatus is arranged such that the heating medium supplied from the heating medium supply device HP flows through the first heat exchanger 120 and the second heat exchanger 220 in the order named.

14 Claims, 14 Drawing Sheets

U.S. PATENT DOCUMENTS 5,761,923 A 6/1998 Maeda
5,761,925 A 6/1998 Maeda
5,791,157 A 8/1998 Maeda
5,816,065 A 10/1998 Maeda
5,931,015 A 8/1999 Maeda
5,943,874 A 8/1999 Maeda
5,950,442 A 9/1999 Maeda et al.
5,950,447 A 9/1999 Maeda et al.
5,966,955 A 10/1999 Maeda

* cited by examiner

DEHUMIDIFYING AIR-CONDITIONING APPARATUS AND DEHUMIDIFYING AIR-CONDITIONING SYSTEM

TECHNICAL FIELD

The present invention relates to a dehumidifying air-conditioning apparatus and a dehumidifying air-conditioning system, and more particularly to a dehumidifying air-conditioning apparatus having a desiccant, and a dehumidifying air-conditioning system having such a dehumidifying air-conditioning apparatus.

BACKGROUND ART

Heretofore, there has been used a desiccant air-conditioning apparatus which utilizes a low temperature heat source and a high temperature heat source, as shown in FIG. 16. The air-conditioning apparatus has a path for process air A from which moisture is adsorbed by a desiccant wheel 103, and a path for regeneration air B which is heated by the high temperature heat source and then passed through the desiccant wheel 103 that has adsorbed the moisture to desorb the moisture in the desiccant for regenerating the desiccant. In order to heat the regeneration air with the high temperature heat source, a heating medium is supplied to a heat exchanger 120 via a path 151 connected to a high temperature heat source supply port 42, and returned to a high temperature heat source return port 43 via a path 152.

The air-conditioning apparatus shown in FIG. 16 comprises a sensible heat exchanger 104 for exchanging heat between the process air from which moisture is adsorbed and the regeneration air before it regenerates a desiccant in the desiccant wheel 103 and before it is heated by the heat exchanger 120. The regeneration air is heated to a certain extent by the sensible heat exchanger 104 before being heated by the heat exchanger 120, and the process air that has been dried by the desiccant is cooled to a certain extent by the sensible heat exchanger 104. Thereafter, the process air is further cooled by a low temperature heat source which is supplied to a heat exchanger 115 from a low temperature heat source supply port 40 via a path 161 and discharged to a low temperature heat source return port 41 via a path 162. In the conventional example shown in FIG. 16, the process air that has been discharged from the heat exchanger 115 is humidified by a humidifier 106, and supplied, with an increased humidity and a lowered dry-bulb temperature, to an air-conditioned space 101.

With this air-conditioning apparatus, the sensible heat exchanger 104 for exchanging heat between the process air that has been discharged from the desiccant wheel 103 and the regeneration air that is to be supplied to the heat exchanger 120 increases an energy-saving effect. The high temperature heat source and the low temperature heat source of the conventional air-conditioning apparatus shown in FIG. 16 are provided by a compression heat pump (not shown).

FIG. 17 shows a Mollier diagram of the compression heat pump used in the conventional air-conditioning apparatus shown in FIG. 16. This diagram is a Mollier diagram in the case where HFC134*a* is used as the refrigerant. A point a represents a state of the refrigerant evaporated by an evaporator of the heat pump, and the refrigerant is in the form of a saturated gas. The refrigerant has a pressure of 4.2 kg/cm$^2$, a temperature of 10° C., and an enthalpy of 148.83 kcal/kg. A point b represents a state of the gas drawn and compressed by a compressor of the heat pump, i.e., a state at the outlet port of the compressor. In this state, the refrigerant has a pressure of 24.1 kg/cm$^2$ and a temperature of 85° C., and is in the form of a superheated gas. The refrigerant gas is cooled by a heating medium in a condenser of the heat pump (heats the heating medium), and reaches a state represented by a point c in the Mollier diagram. In the point c, the refrigerant is in the form of a saturated gas and has a pressure of 24.1 kg/cm$^2$ and a temperature of 75° C. Under this pressure, heat is removed from the refrigerant by the heating medium, and the refrigerant is condensed and reaches a state represented by a point d. In the point d, the refrigerant is in the form of a saturated liquid and has the same pressure and temperature as those in the point c, i.e., a pressure of 24.1 kg/cm$^2$ and a temperature of 75° C. and an enthalpy of 127.13 kcal/kg. The refrigerant liquid is depressurized by an expansion valve to a saturation pressure of 4.2 kg/cm$^2$ at a temperature of 10° C. A mixture of the refrigerant liquid and the gas at a temperature of 10° C. is delivered to the evaporator, in which the mixture removes heat from a chilling medium and is evaporated to reach the saturated gas at the point a in the Mollier diagram. The saturated gas is drawn into the compressor again, and the above cycle is repeated. FIG. 18 shows the manner in which the temperature changes in the heat exchange between the refrigerant and the heating medium.

The cooled chilling medium is supplied via the path 161 to the heat exchanger 115, and returned via the path 162 to the evaporator of the heat pump. The heating medium that has been heated to about 70° C. is supplied via the path 151 to the heat exchanger 120, in which the heating medium is cooled to 60–65° C., and then returned via the path 152 to the condenser of the heat pump. The sensible heat exchanger 104 comprises a rotary heat exchanger as shown in FIG. 16, or a cross-flow type heat exchanger in which a process air and a regeneration air flow perpendicularly to each other.

In the above conventional air-conditioning apparatus, the sensible heat exchanger 104 for preliminarily cooling the process air before it is cooled by the heat exchanger 115 plays an important role. However, since the sensible heat exchanger 104 generally occupies a large volume in the system, it is difficult to design the system, and the system is forced to be large in size. Further, since a large amount of the heating medium and the chilling medium is used in the system, the diameter of heating medium pipes through which the heating medium circulates becomes large. Therefore, it is difficult to install those heating medium pipes. Furthermore, a pump for delivering the heating medium tends to consume large power.

DISCLOSURE OF INVENTION

It is therefore an object of the present invention to provide a compact dehumidifying air-conditioning apparatus, and a dehumidifying air-conditioning apparatus and a dehumidifying air-conditioning system with reduced power consumed for delivering a heating medium or a chilling medium.

To achieve the above object, a dehumidifying air-conditioning apparatus according to the present invention described in claim 1 has, as shown in FIG. 1, a moisture adsorption device 103 having a desiccant for adsorbing moisture from process air, adsorbed moisture being desorbed by regeneration air; a first heat exchanger 120 for exchanging heat between the regeneration air and a heating medium, the first heat exchanger 120 being disposed upstream of the moisture adsorption device 103 with respect to a flow of the regeneration air; a second heat exchanger 220 for exchanging heat between the process air and the heating medium, the second heat exchanger 220 being disposed downstream of the moisture adsorption device 103 with respect to a flow of the process air; and a heating medium supply device HP for heating the heating medium supplied to the first heat exchanger 120 and the second heat exchanger 220; wherein the arrangement is such that the heating medium supplied from the heating medium supply device HP flows through the first heat exchanger 120 and the second heat exchanger 220 in the order named.

With the above arrangement, since the heating medium supplied from the heating medium supply device HP flows through the first heat exchanger and the second heat exchanger in the order named, heat equivalent to a portion of heat used to heat the regeneration air in the first heat exchanger can be recovered from the process air in the second heat exchanger.

As described in claim 2, the dehumidifying air-conditioning apparatus may further comprise a third heat exchanger 115 for exchanging heat between the process air and a chilling medium, and the third heat exchanger 115 may be disposed downstream of the second heat exchanger 220 with respect to the flow of the process air. With the third heat exchanger 115, it is possible to further cool the process air.

As described in claim 3, in the dehumidifying air-conditioning apparatus described in claim 2, the heating medium supply device HP may be arranged to supply the chilling medium, and comprise a heat pump for pumping heat from the chilling medium to the heating medium. With this arrangement, since the heat pump pumps heat from the chilling medium to the heating medium, the heat can effectively be utilized.

As described in claim 4, in the dehumidifying air-conditioning apparatus described in claim 2 or 3, the difference between the temperature of the chilling medium at an inlet of the third heat exchanger 115 and the temperature of the chilling medium at an outlet of the third heat exchanger 115 is 10° C. or less. With this arrangement, heat can be recovered from another sensible heat processing machine (e.g., a fan coil) installed in an air-conditioned space at an air temperature ranging from 25 to 27° C. via cold water (20 to 10° C.), and can be reused to heat the heating medium. Therefore, the heat can be used in multiple ways, and an energy-saving system can be achieved.

As described in claim 5, in the dehumidifying air-conditioning apparatus described in any one of claims 1 through 4, the difference between the temperature of the heating medium at an inlet of the first heat exchanger and the temperature of the heating medium at an outlet of the second heat exchanger should preferably be 15° C. or more.

With the above arrangement, the temperature difference of the heating medium that can be used is a large value of 15° C. or more. Therefore, in a system in which a pipe for the heating medium is long and which uses a heating medium delivery device (a pump or the like), the power to deliver the heating medium is reduced, and the diameter of a pipe for delivering the heating medium is reduced. The pipe can thus be installed with ease at a reduced cost.

To achieve the above object, a dehumidifying air-conditioning system according to the present invention described in claim 6 has, as shown in FIG. 14, a dehumidifying air-conditioning apparatus 70A through 70E according to any one of claims 1 through 5; a heating medium pipe 30, 31 for supplying the heating medium from the heating medium supply device 1 to the first heat exchanger 120 and the second heat exchanger 220; and a chilling medium pipe 20, 21 for supplying the chilling medium from the heating medium supply device 1 (HP) to the third heat exchanger 115.

An invention according to another aspect is described in claim 7. As shown in FIG. 1, a dehumidifying air-conditioning apparatus comprises a moisture adsorption device 103 having a desiccant for adsorbing moisture from process air, adsorbed moisture being desorbed by regeneration air; a first heat exchanger 120 for exchanging heat between the regeneration air and a heating medium in a vapor phase, the first heat exchanger being disposed upstream of the moisture adsorption device with respect to a flow of the regeneration air; and a second heat exchanger 220 for exchanging heat between the process air and the heating medium which has exchanged heat in the first heat exchanger 120, the second heat exchanger being disposed downstream of the moisture adsorption device 103 with respect to a flow of the process air. Typically, the heating medium which has exchanged heat in the first heat exchanger 120 is condensed into a liquid phase, and the second heat exchanger 220 exchanges heat between the heating medium in the liquid phase and the process air.

With the above arrangement, inasmuch as the heating medium flows through the first heat exchanger and the second heat exchanger in the order named, heat equivalent to a portion of heat used to heat the regeneration air in the first heat exchanger can be recovered from the process air by the second heat exchanger. Typically, the heat is transferred using phase changes of the heating medium.

As described in claim 8, the above apparatus may further comprise a third heat exchanger 115 for exchanging heat between the process air and a chilling medium in a liquid phase, and the third heat exchanger may be disposed downstream of the second heat exchanger 220 with respect to the flow of the process air. With this arrangement, the third heat exchanger 115 further cools the process air that has been cooled by the second heat exchanger 220.

As described in claim 9, the dehumidifying air-conditioning apparatus described in claim 7 or 8 may further comprise a switching device 172 disposed between the first heat exchanger 120 and the second heat exchanger 220 for changing a flow of the heating medium which has exchanged heat in the first heat exchanger 120. With this arrangement, the switching device changes the flow of the heating medium, so that the heating medium can bypass the second heat exchanger 220.

To achieve the above object, a dehumidifying air-conditioning system according to the present invention defined in claim 10 may comprise, as shown in FIG. 15, a dehumidifying air-conditioning apparatus described in claim 8; and a heat pump 1 for pumping heat from the chilling medium supplied to the third heat exchanger 115 to the heating medium supplied to the first heat exchanger 120.

With this arrangement, the heat pump can pump the heat removed from the chilling medium in the third heat exchanger, and the pumped heat can be imparted to the heating medium in the first heat exchanger. The heat is transferred using phase changes of the heating medium. Typically, the heating medium can spontaneously be circulated by gravity, so that the power to transfer the heat can extremely be reduced.

As described in claim 11, the dehumidifying air-conditioning system according to claim 10 may comprise a plurality of the dehumidifying air-conditioning apparatus for one the heat pump. With this arrangement, it is possible to construct a system in which the chilling medium that is heated and cooled in a centralized manner by the single heat pump is used by a plurality of dehumidifying air-conditioning apparatus.

As described in claim 12, in the dehumidifying air-conditioning system according to claim 10 or 11, the heat pump 1 may comprise a fourth heat exchanger 35 for imparting heat to the heating medium; and a fifth heat exchanger 25 for removing heat from the chilling medium.

As described in claim 13, in the dehumidifying air-conditioning system described in claim 12, the fourth heat exchanger 35 should preferably be disposed relatively vertically downwardly of the dehumidifying air-conditioning apparatus, and the fifth heat exchanger 25 should preferably be disposed relatively vertically upwardly of the dehumidifying air-conditioning apparatus.

With the above arrangement, typically, heat is imparted to the heating medium to evaporate the heating medium in the fourth heat exchanger. Since the evaporated heating medium is lighter than the heating medium as a liquid, the evaporated heating medium is spontaneously circulated to the dehumidifying air-conditioning apparatus positioned relatively vertically upwardly of the fourth heat exchanger. Typically, heat is removed from the chilling medium to liquefy the chilling medium in the fifth heat exchanger. Since the liquefied chilling medium is heavier than the chilling medium as a gas, the liquefied chilling medium is spontaneously circulated to the dehumidifying air-conditioning apparatus positioned relatively vertically downwardly of the fifth heat exchanger.

As described in claim 14, the dehumidifying air-conditioning system according to any one of claims 10 through 13 may further comprise a chilling machine 9 for removing heat from the chilling medium. When a cooling load is large, the chilling machine 9 can be operated in addition to the heat pump 1 to process the large cooling load. In this case, the chilling machine may be positioned anywhere in the path of the chilling medium. Typically, the chilling machine may be connected to the fifth heat exchanger 25, and may have an evaporator incorporated in the fifth heat exchanger 25, for example.

BEST MODE FOR CARRYING OUT THE INVENTION

A first embodiment of the present invention will be described below with reference to the accompanying drawings. In the accompanying drawings, the identical or corresponding parts are denoted by identical characters, and will not be described repeatedly.

Figure 1:
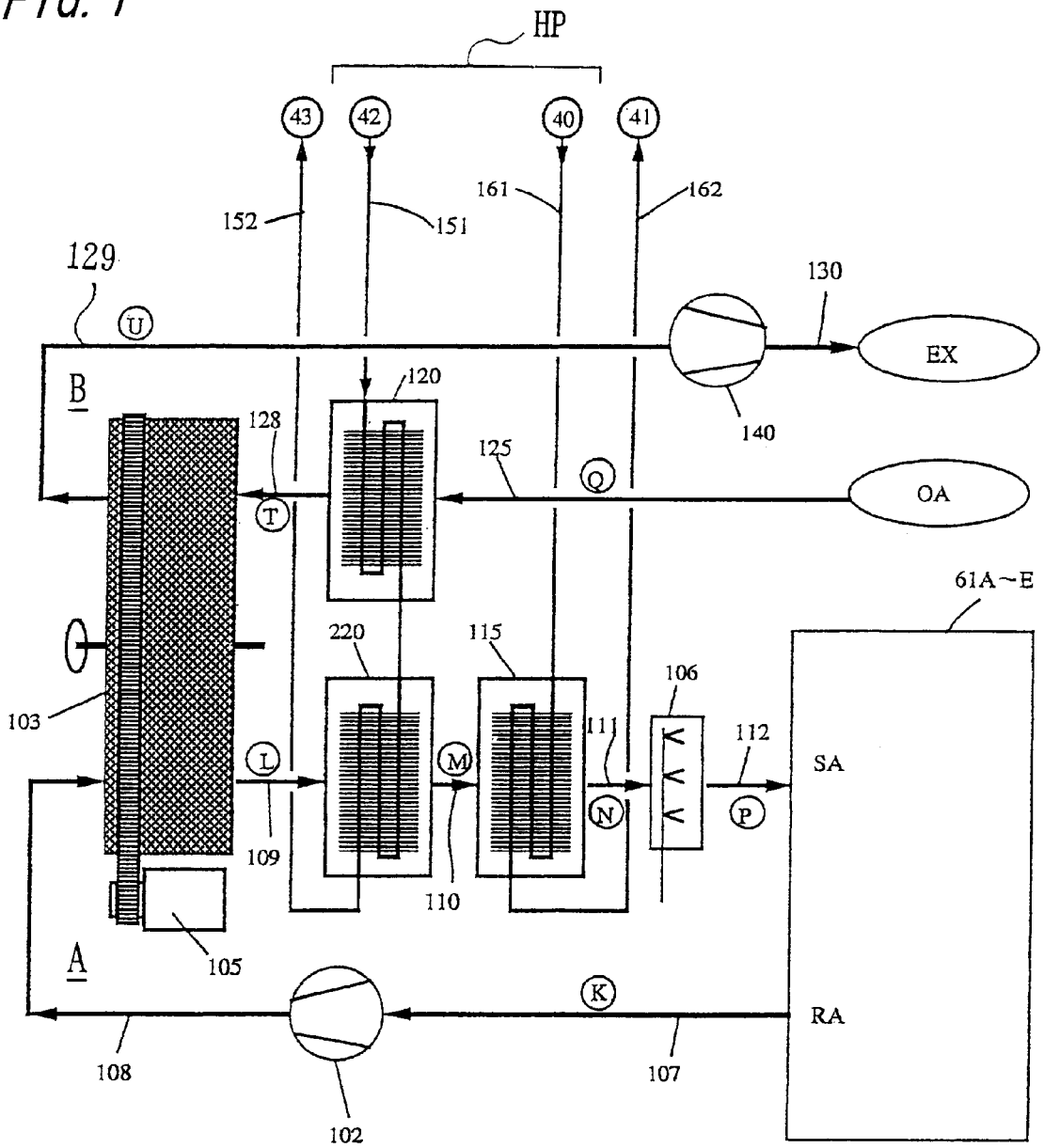
FIG. 1 is a flow diagram of a dehumidifying air-conditioning apparatus according to a first embodiment of the present invention.

A dehumidifying air-conditioning apparatus according to a first embodiment of the present invention will be described below with reference to a flow diagram shown in FIG. 1. The air-conditioning system lowers the humidity of process air with a desiccant to maintain a comfortable environment in air-conditioned spaces 61A through 61E which are supplied with the process air. In FIG. 1, the dehumidifying air-conditioning apparatus comprises a blower 102 for circulating process air A, a desiccant wheel 103 filled with a desiccant, a second heat exchanger 220 according to the present invention, a third heat exchanger 115, and a humidifier 106, and those are successively arranged along a path for the process air A from the air-conditioned spaces 61A through 61E in the order named. The process air A is returned to the air-conditioned spaces 61A through 61E.

The dehumidifying air-conditioning apparatus also comprises a path 125, a first heat exchanger 120 according to the present invention for heating regeneration air B before the regeneration air is delivered to the desiccant wheel 103, the desiccant wheel 103, and a blower 140 for circulating the regeneration air B, and those are successively arranged along a path for the regeneration air B from an outdoor air OA in the order named. The regeneration air B is discharged to an outdoor air EX.

A hot water pipe 151 for introducing hot water as a heating medium is connected to a heating medium supply port 42 of a heat pump HP shown in FIG. 2, described later on, and a hot water inlet port of the heat exchanger 120. The heat exchanger 120 comprises a counter flow heat exchanger for exchanging heat between the hot water and the regeneration air which flow in opposite directions. The heat exchanger 120 has a hot water outlet port connected to a hot water inlet port of the heat exchanger 220 via a hot water pipe. The heat exchanger 220 is also arranged so as to exchange heat between the hot water and the process air which flow in opposite directions. The heat exchanger 220 has a hot water outlet port connected to a heating medium return port 43 of the heat pump via a hot water pipe 152.

The cold water pipe 161 for introducing cold water as a chilling medium is connected to the chilling medium supply port 40 of the heat pump HP and a cold water inlet port of the heat exchanger 115. The heat exchanger 115 is arranged so as to exchange heat between the cold water and the regeneration air which flow in opposite directions. The heat exchanger 115 has a cold water outlet port connected to a chilling medium return port 41 of the heat pump via a cold water pipe 162.

The desiccant wheel 103, which serves as a moisture adsorption device, is coupled to a geared motor 105 as a driving device for rotating the desiccant wheel 103 at the rate of about one rotation in several minutes, via a transmitting device such as a chain or a belt.

Figure 2:
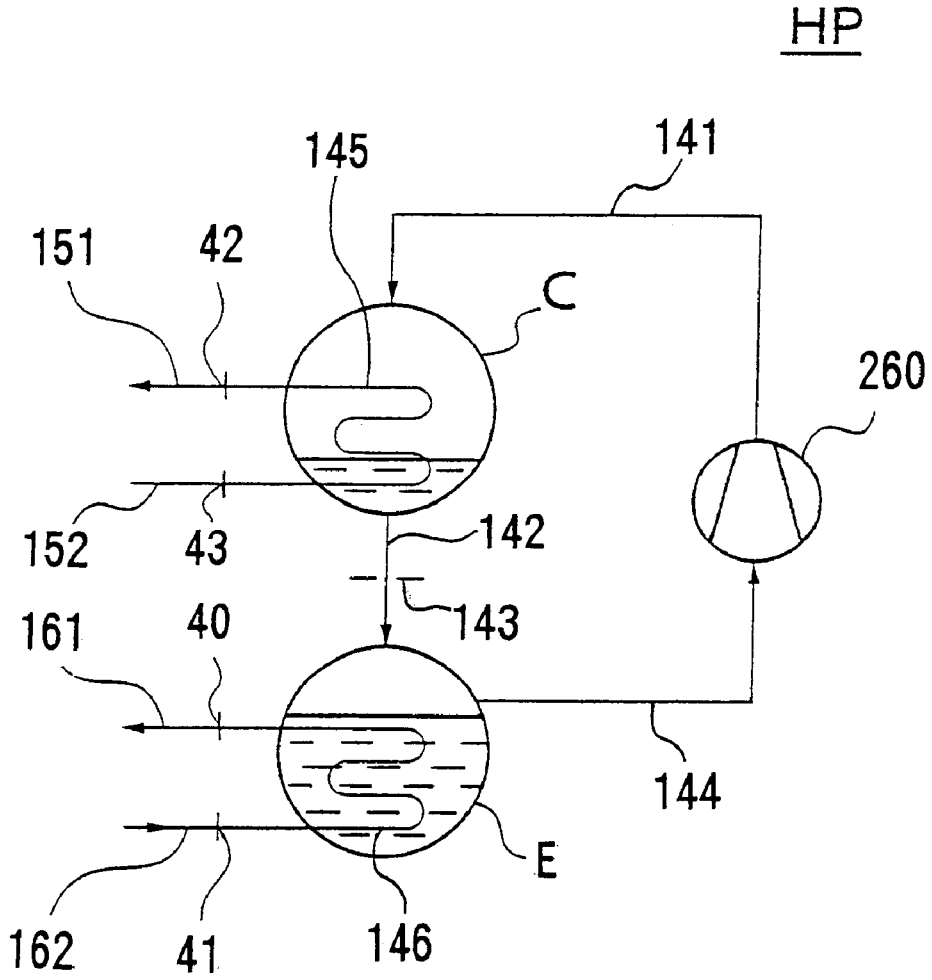
FIG. 2 is a flow diagram of a heat pump suitable for use in the dehumidifying air-conditioning apparatus shown in FIG. 1.

An example of the heat pump HP that can be used in the apparatus shown in FIG. 1 is illustrated in a flow diagram of FIG. 2. In FIG. 2, a refrigerant compressor 260 has an outlet port connected to a refrigerant condenser C via a refrigerant gas pipe 141. The refrigerant condenser C has a port defined in the bottom thereof for removing a refrigerant liquid condensed in the refrigerant condenser C. This port is connected to a refrigerant evaporator E via a refrigerant pipe 142, which has a throttle 143. The refrigerant evaporator E has a port defined in an upper portion thereof for removing a refrigerant gas evaporated in the refrigerant evaporator E. This port is connected to an inlet port of the compressor 260 via a refrigerant gas pipe 144.

A heat exchange tube 145 for exchanging heat between the heating medium and the refrigerant gas is mounted in the refrigerant condenser C. The heating medium supply port 42 for supplying the heating medium to an external device and the heating medium return port 43 for returning the heating medium from an external device are connected to the heat exchange tube 145. The heating medium pipe 151 is connected to the heating medium supply port 42, and the heating medium pipe 152 is connected to the heating medium return port 43.

A heat exchange tube 146 for exchanging heat between the chilling medium and the refrigerant liquid to be evaporated is mounted in the refrigerant evaporator E. A chilling medium supply port 40 for supplying the chilling medium to an external device and a chilling medium return port 41 for returning the chilling medium from an external device are connected to the heat exchange tube 146. The chilling medium pipe 161 is connected to the chilling medium supply port 40, and the chilling medium pipe 162 is connected to the chilling medium return port 41.

The refrigerant gas heated and evaporated in the evaporator E by the chilling medium supplied from the chilling medium return port 41 is drawn into the compressor 260, compressed thereby, and discharged into the condenser C. The chilling medium cooled by the evaporation of the refrigerant in the evaporator E is supplied from the chilling medium supply port 40 to the external device.

The refrigerant liquid cooled and condensed in the condenser C by the heating medium supplied from the heating medium return port 43 is depressurized by the throttle 143 and supplied to the evaporator E. The heating medium heated by the condensation of the refrigerant in the condenser C is supplied from the heating medium supply port 42 to the external device.

Figure 3:
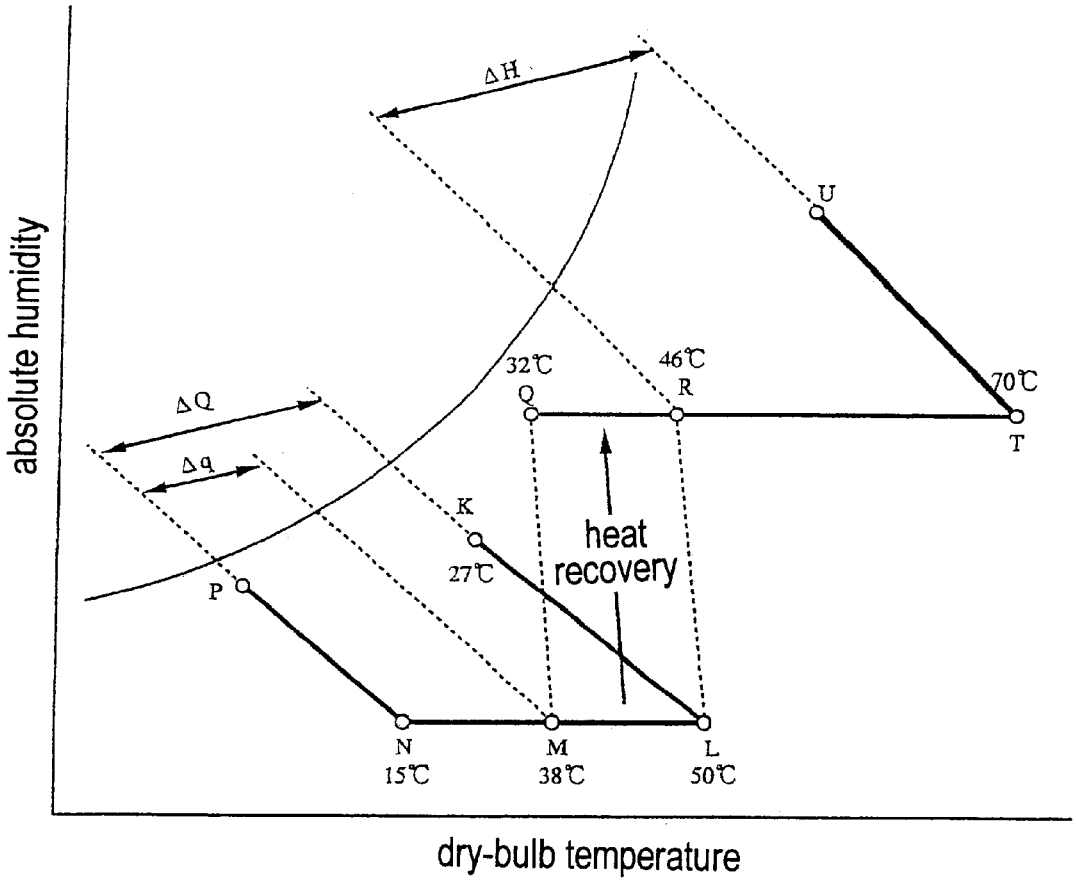
FIG. 3 is a psychrometric chart illustrative of operation of the dehumidifying air-conditioning apparatus shown in FIG. 1.

An example of operation of the first embodiment shown in FIG. 1, with specific temperatures taken into consideration, will be described below with reference to a psychrometric chart shown in FIG. 3. FIG. 1 will be referred to for structural details. In FIG. 3, alphabetical letters K through N, and P, and Q through U represent states of air in various regions, and correspond to the alphabetical letters which are encircled in the flow diagram of FIG. 1.

First, a flow of the process air A will be described below. In FIG. 3, the process air (in a state K) at about 27° C. is drawn via a process air path 107 from the air-conditioned spaces 61A through 61E by the blower 102, which delivers the process air via a process air path 108 to the desiccant wheel 103 as a moisture adsorption device. In the desiccant wheel 103, the desiccant adsorbs the moisture from the process air to lower the absolute humidity thereof, and the dry-bulb temperature of the process air is increased by the heat of adsorption in the desiccant, so that the process air reaches a state L at about 50° C. The air is then delivered via a path 109 for the process air to the second heat exchanger 220. In the second heat exchanger 220, the process air is cooled into air in a state M at about 38° C. by the heating medium (whose temperature has been lowered by the first heat exchanger, as described later on) while its absolute humidity is being kept constant. The air is then introduced via a path 110 into the third heat exchanger 115. In the third heat exchanger 115, the air is further cooled into air in a state N at about 15° C. by the chilling medium while its absolute humidity is kept constant. The air then flows through a duct 111 into the humidifier 106. In the humidifier 106, the air is isentropically changed to increase its absolute humidity and to lower its dry-bulb temperature, and reaches a state P. The air is then returned as process air SA at an appropriate humidity and an appropriate temperature through a duct 112 to the air-conditioned spaces 61A through 61E.

Next, a flow of the regeneration air B will be described below. In FIG. 3, the regeneration air (in a state Q) at about 32° C. from the outdoor air OA is drawn via a path 125 for the regeneration air into the first heat exchanger 120. In the first heat exchanger 120, the regeneration air exchanges heat with the heating medium at a high temperature from the heat pump HP to increase its dry-bulb temperature, and reaches a state T at about 70° C. The relationship between the heat exchanger 120 and the heat exchanger 220 will be described below. The heating medium whose temperature has been lowered by the heat exchanger 120 cools the process air and increases its temperature, as described above. This process represents a heat recovery for the heating medium. The heating medium which has gained the recovered heat is returned to the heat pump HP, heated thereby, and supplied to the heat exchanger 120, in which the heating medium heats the regeneration air. As described above, the regeneration air is heated from about 32° C. to about 70° C. Of the temperature increase, an increase up to a state R at about 46° C. represents the recovery of heat from the process air by the heat exchanger 220, as shown in FIG. 3.

The regeneration air heated to about 70° C. by the heat exchanger 120 is delivered through a path 128 to the desiccant wheel 103. In the desiccant wheel 103, the regeneration air removes moisture from the desiccant for regenerating the desiccant, increases its absolute humidity, and lowers its dry-bulb temperature by the heat of desorption of moisture in the desiccant, thus reaching a state U. The regeneration air is drawn via a path 129 into the blower 140 for circulating the regeneration air, and then discharged via a path 130 into the outdoor air EX.

Figure 4:
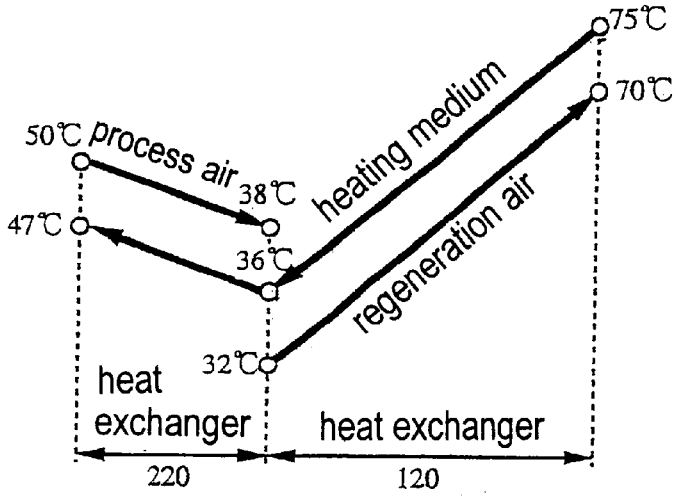
FIG. 4 is a diagram illustrative of a heat exchange between a heating medium and process air and between a heating medium and regeneration air with respect to the embodiment taken into consideration in FIG. 3.

Operation of the heat exchanger 120 and the heat exchanger 220 in the example shown in FIG. 3 will further be described below with reference to FIG. 4. In the heat exchanger 120, the heating medium heated to about 75° C. by the heat pump HP and the outdoor air at about 32° C. used as the regeneration air exchange heat with each other while flowing in opposite directions. The heating medium lowers its temperature from about 75° C. to about 36° C. At this time, the regeneration air which exchanges heat with the heating medium increases its temperature from about 32° C. to about 70° C.

Then, the heating medium cooled to about 36° C. as described above then exchanges heat with the process air in the heat exchanger 220 while the heating medium and the process air flow in opposite directions, and is heated from about 36° C. to about 47° C. At this time, the process air which exchanges heat with the heating medium lowers its temperature from about 50° C. to about 38° C.

Figure 5:
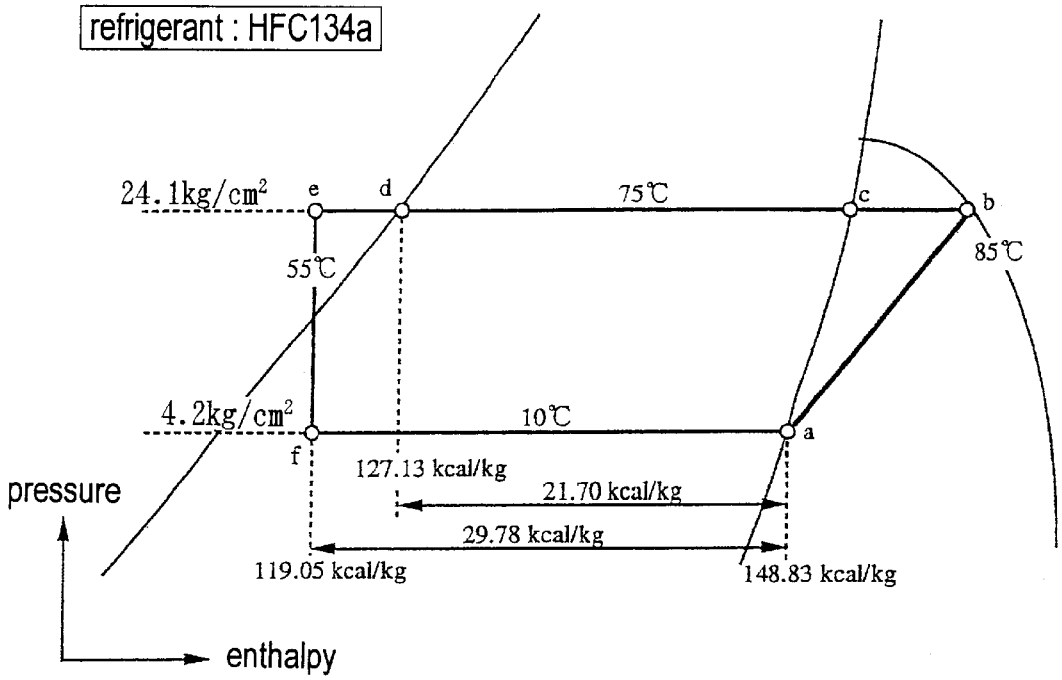
FIG. 5 is a Mollier diagram of a heat pump used in the dehumidifying air-conditioning apparatus shown in FIG. 1.

A refrigerant cycle of the heat pump HP will be described below with reference to FIG. 5. FIG. 5 is a Mollier diagram in the case where a refrigerant HFC134*a* is used. In FIG. 5, the horizontal axis represents the enthalpy and the vertical axis the pressure. FIG. 2 will be referred to for structural details of the heat pump HP.

In FIG. 5, a point a represents a state of the refrigerant at the refrigerant outlet port of the evaporator E (in FIG. 2) which supplies the chilling medium to the third heat exchanger 115 shown in FIG. 1, and the refrigerant is in the form of a saturated gas. The refrigerant has a pressure of 4.2 kg/cm$^2$, a temperature of 10° C., and an enthalpy of 148.83 kcal/kg. A point b represents a state of the gas drawn and compressed by the compressor 260, i.e., a state at the outlet port of the compressor 260. In this state, the refrigerant has a pressure of 24.1 kg/cm$^2$ and a temperature of 85° C., and is in the form of a superheated gas.

The refrigerant gas is cooled in the refrigerant condenser C, and reaches a state represented by a point c in the Mollier diagram. In the point c, the refrigerant is in the form of a saturated gas and has a pressure of 24.1 kg/cm$^2$ and a temperature of 75° C. Under this pressure, the refrigerant is further cooled and condensed, and reaches a state represented by a point d. In the point d, the refrigerant is in the form of a saturated liquid and has the same pressure and temperature as those in the point c, i.e., a pressure of 24.1 kg/cm$^2$ and a temperature of 75° C. and an enthalpy of 127.13 kcal/kg. The heating medium that is returned to the condenser C has a temperature of about 47° C., as described above. The condenser C has such a structure that the refrigerant liquid can be subcooled with the heating medium. The refrigerant liquid is supercooled to a state e at about 55° C. At the point e, the refrigerant liquid has an enthalpy of 119.05 kcal/kg. The refrigerant liquid in this state is depressurized by the throttle 143, and is returned to the evaporator E. This state is represented by a point f. From this state, heat is removed from the chilling medium by the refrigerant liquid to evaporate the refrigerant liquid and to return the refrigerant to the state represented by the point a. In this manner, the refrigerant cycle is repeated.

Figure 17:
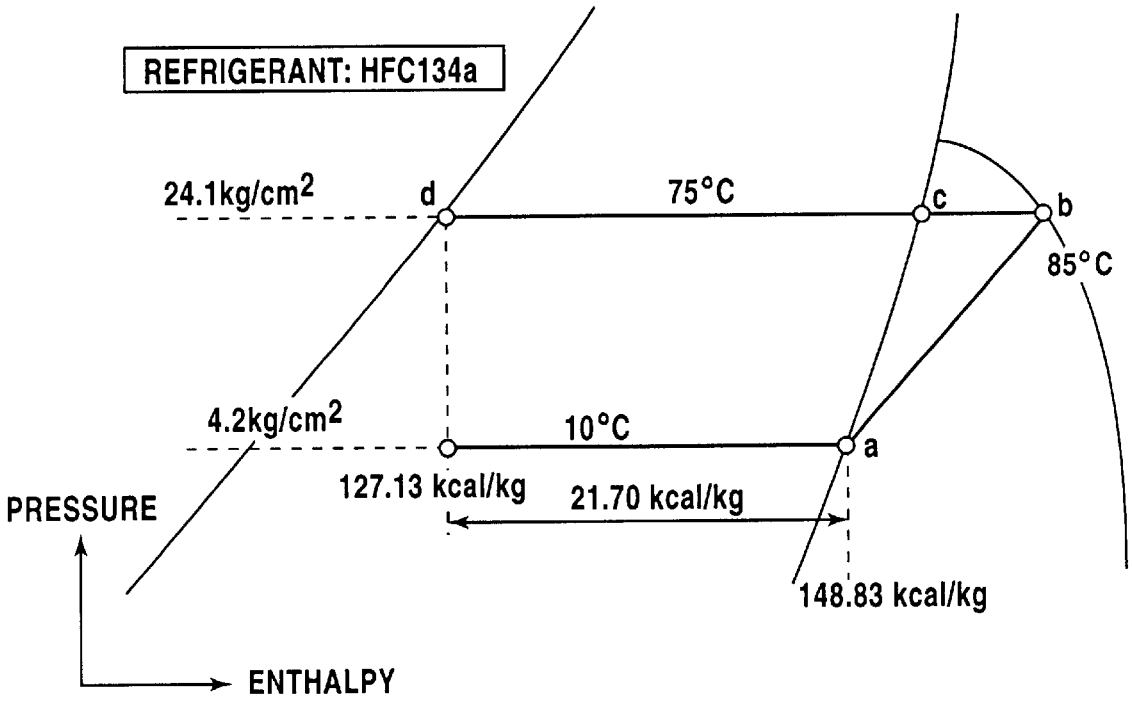
FIG.17 PRIOR ART
FIG. 17 is a Mollier diagram of a heat pump used in the conventional dehumidifying air-conditioning apparatus shown in FIG. 16.
Figure 18:
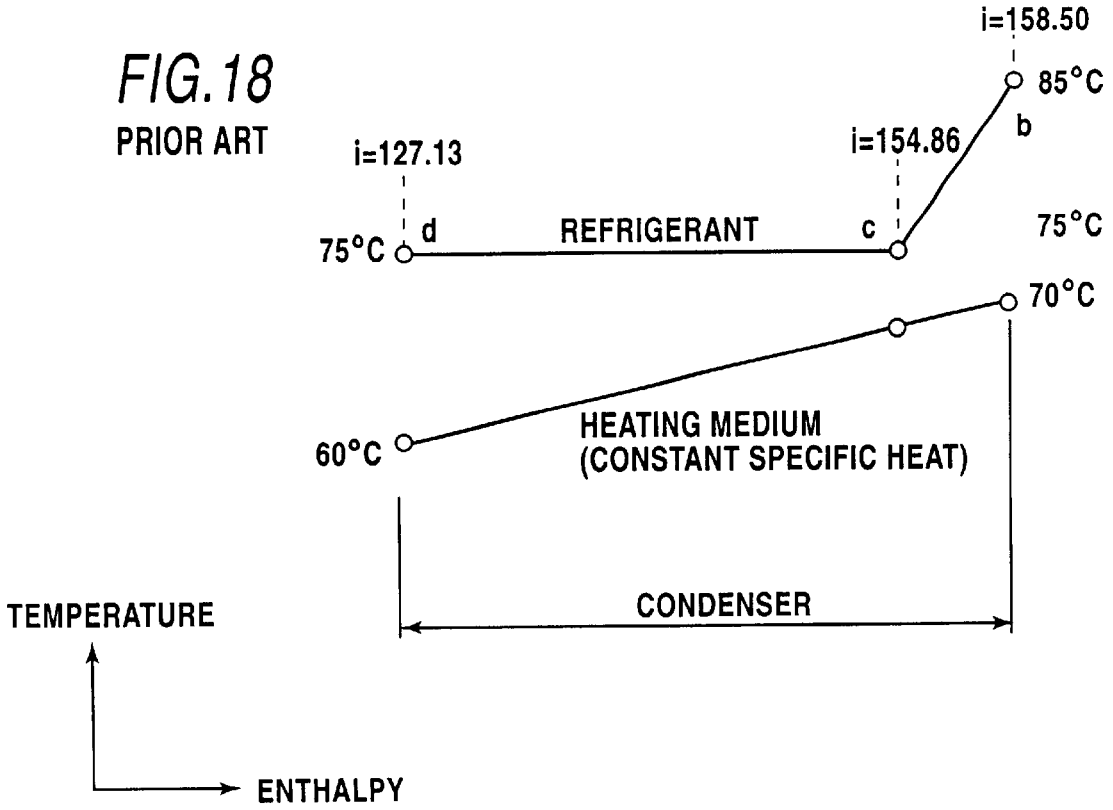
FIG.18 PRIOR ART
FIG. 18 is a diagram illustrative of a heat exchange between a refrigerant and a heating medium in the heating pump shown in FIG. 17.

In this example, as compared with the conventional example represented by the Mollier diagram of FIG. 17, the cooling effect ratio is calculated as (148.83−119.05)/(148.83−127.13)=29.78/21.70=1.37, and increased by about 37%. The increase in the cooling effect results in a shift of the point N to the left (in a direction to lower the dry-bulb temperature) in the psychrometric chart shown in FIG. 3, and can lead the increased heating capacity, the increased efficiency, the compactness of the apparatus, and the reduction in cost. While the compression heat pump has been described above, an absorption heat pump may be employed to increase the cooling effect and the heating capacity of the heating medium by similarly recovering the sensible heat of the condensed refrigerant.

Figure 6:
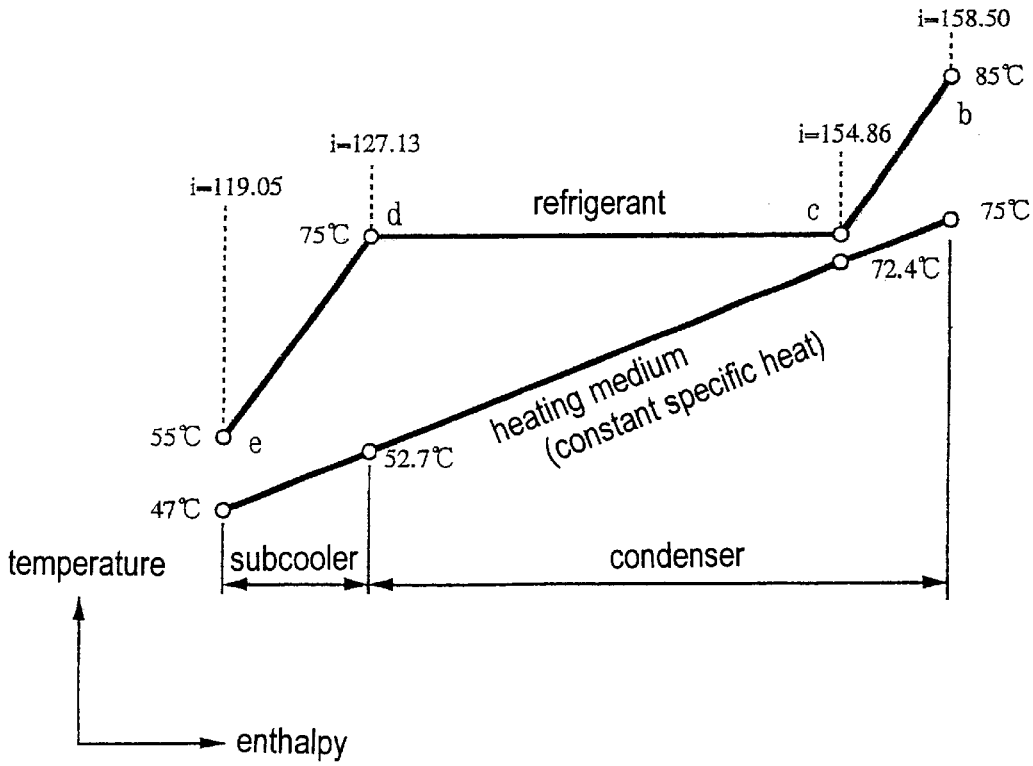
FIG. 6 is a diagram illustrative of a heat exchange between a refrigerant and a heating medium with respect to the embodiment taken into consideration in FIG. 3.

Temperature changes with respect to enthalpy changes of the refrigerant and the heating medium in the condenser C in the above example will be described below with reference to FIG. 6. First, changes in enthalpy and temperature of the refrigerant will be described below. In FIG. 6, the refrigerant is supplied in a superheated state represented by the point b in FIG. 5 (the temperature is 85° C. and the enthalpy is 158.50 kcal/kg) to the condenser C. The refrigerant gas is cooled by the heating medium into a saturated gas at the point c shown in FIG. 5 (the temperature is 75° C. and the enthalpy is 154.86 kcal/kg). From this state, heat is removed from the refrigerant gas to change the enthalpy from 154.86 kcal/kg to 127.13 kcal/kg while the temperature is being kept constant at 75° C. In FIG. 5, the refrigerant is in the form of a saturated liquid at the point d. The refrigerant is further supercooled to about 55° C. by the heating medium, and reaches a state represented by the point e shown in FIG. 5.

While the refrigerant is thus changing its state, the heating medium which flows in a direction opposite to the refrigerant starts exchanging heat with the refrigerant at a point corresponding to the point e when supplied at about 47° C to the condenser C. At a point corresponding to the point d of the refrigerant, the heating medium is heated to about 52.7° C. At a point corresponding to the point c, the temperature of the heating medium increases to about 72.4° C. The heating medium is further heated by the superheated refrigerant gas. At a point corresponding to the point b, the heating medium increases its temperature to 75° C., and is supplied to the first heat exchanger 120 shown in FIG. 1.

In this example, the difference between the temperature of the heating medium supplied from the heat pump HP and the temperature of the heating medium returned to the heat pump HP is of a large value of 75−47=28° C. Since the temperature difference that can be used is large, the amount of the heating medium that flows to transfer the same amount of heat may be small. Therefore, the diameters of the heating medium pipes 151, 152 may be reduced, the heating medium pipes 151, 152 may be installed with ease, and the power consumed by the pump connected to the heating medium pipes 151, 152 to deliver hot water as the heating medium may be reduced. Heretofore, the temperature difference of the heating medium that can be used is in the range from 5 to 7° C. If the temperature difference of the heating medium that can be used is 23° C., for example, then the amount of the heating medium is in the range from 1/3.3 to 1/4.6. The temperature difference of the heating medium that can be used is equal to or greater than 15° C., preferably equal to or greater than 20° C., or more preferably equal to or greater than 25° C.

In this embodiment, since the second heat exchanger 220 as the heat exchanger for the heating medium is disposed in the process air system, the apparatus can be operated in a heating operation mode. In this mode, the blower 140 is shut off to stop the supply of the regeneration air. Outdoor air may be used as a low temperature heat source for the heat pump, for example. In order to use outdoor air, the heat of outdoor air may be introduced into the evaporator E using a heat exchanger (not shown) for the low temperature heat source.

Figure 7:
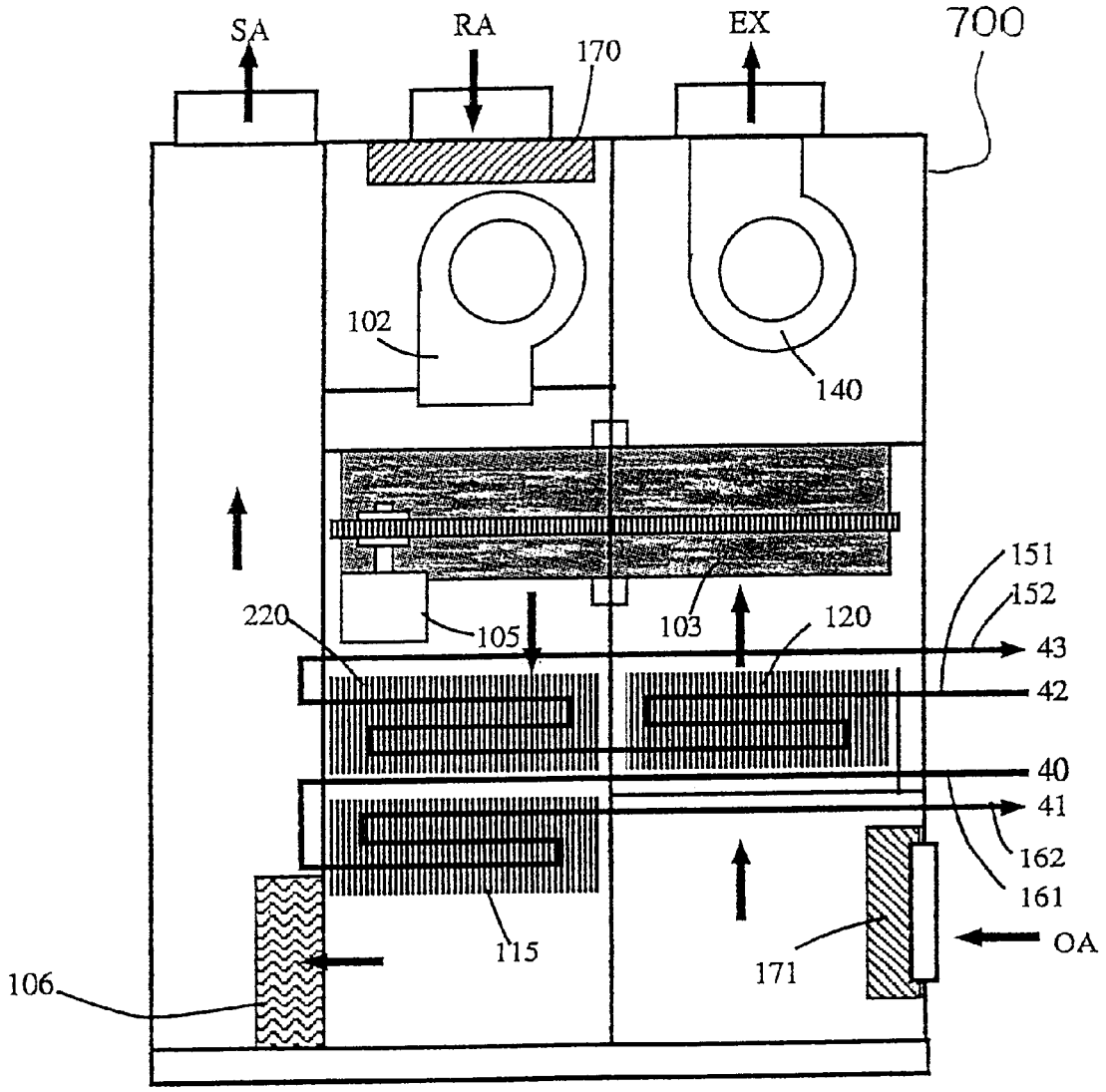
FIG. 7 is a schematic cross-sectional front view showing an actual structure of the dehumidifying air-conditioning apparatus according to the first embodiment shown in FIG. 1.

A mechanical arrangement of the dehumidifying air-conditioning apparatus described above will be described below with reference to FIG. 7. In FIG. 7, the devices constituting the apparatus are housed in a cabinet 700 in the form of a rectangular parallelepiped, which is formed of thin steel panels. An inlet port for introducing the outdoor air OA for use as the regeneration air is defined in a lower portion of a vertical side wall of the cabinet 700. The introduced outdoor air flows upwardly from the lower portion, passes through the heat exchanger 120 and the desiccant wheel 103, and is discharged by the blower 140 from a discharge port for regeneration air which is defined in an upper wall of the cabinet 700. The desiccant wheel 103 has its rotatable shaft extending vertically.

An inlet port for process air RA is defined centrally in the upper wall of the cabinet 700 adjacent to the discharge port for regeneration air, and the blower 102 is disposed downwardly of the inlet port for process air RA. The desiccant wheel 103 is disposed below the blower 102, the heat exchanger 220 below the desiccant wheel 103, and the heat exchanger 115 below the heat exchanger 220. The process air that has passed through these devices flows laterally at the bottom of the cabinet 700 and then changes its direction to an upward direction, and is supplied from an opening defined in the upper wall of the cabinet 700 into an air-conditioned space. A filter 171 is disposed over the outdoor air inlet opening, and a filter 170 is disposed over the process air inlet opening. The humidifier 106 is positioned downstream of the heat exchanger 115 in the path of the process air.

Figure 16:
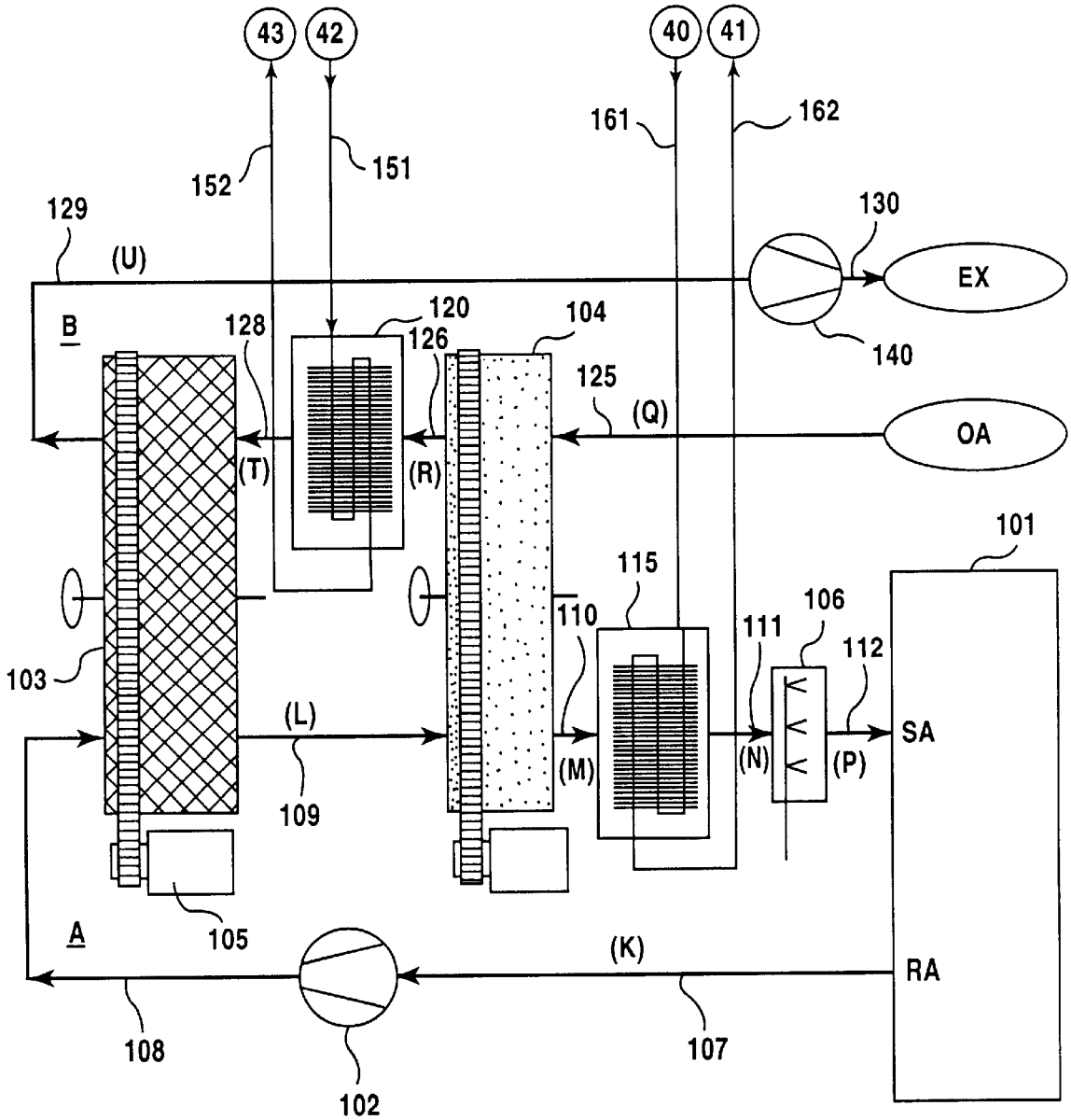
FIG.16 PRIOR ART
FIG. 16 is a flow diagram of a conventional dehumidifying air-conditioning apparatus.

In the first embodiment, as described above, the dehumidifying air-conditioning apparatus is compact as it does not need the rotary or cross-flow type sensible heat exchanger 104 (FIG. 16) which has been used in the conventional apparatus.

Figure 8:
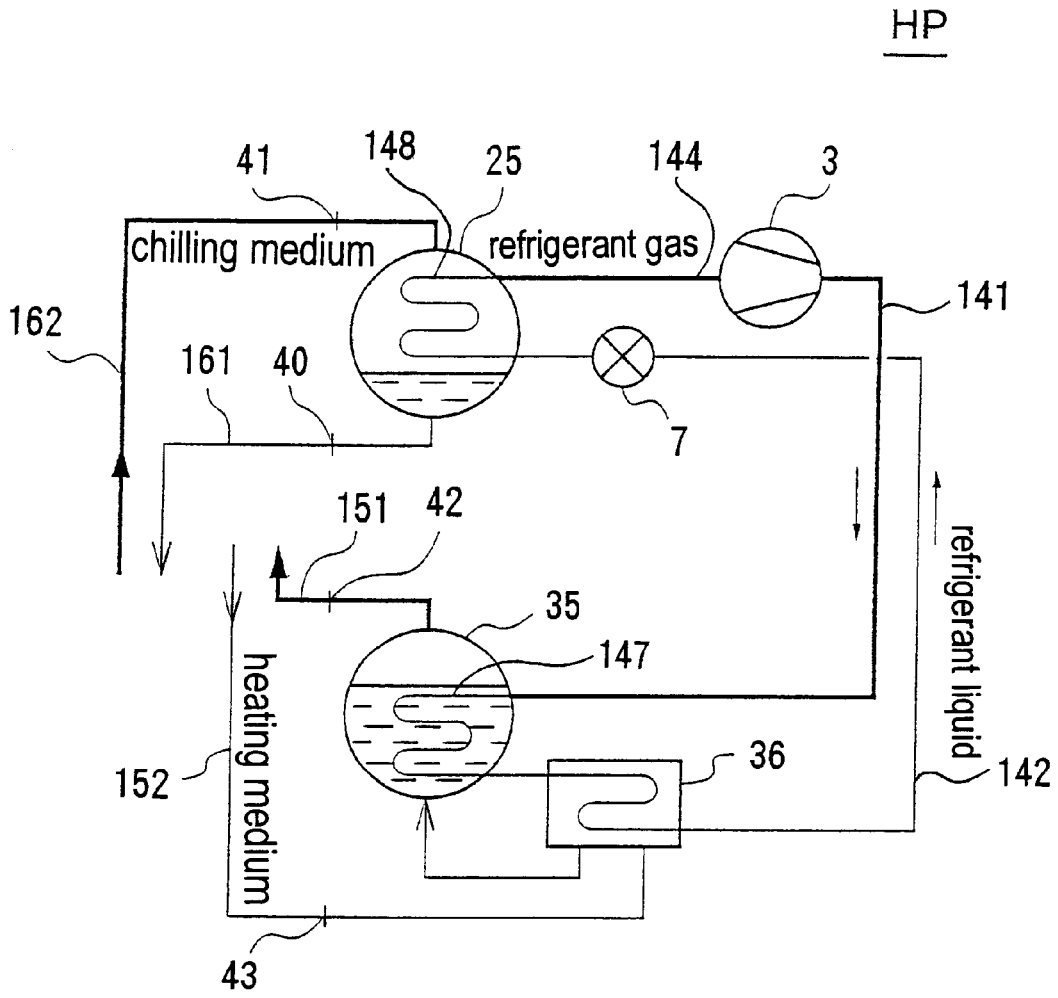
FIG. 8 is a flow diagram of a heat pump suitable for use in the dehumidifying air-conditioning apparatus shown in FIG. 1.

A second embodiment of the present invention will be described below with reference to FIG. 8. The second embodiment has an overall arrangement similar to the arrangement shown in FIG. 1, except details of the heat pump. In FIG. 8, a refrigerant compressor 3 has an outlet port connected to a fourth heat exchanger 35, which is a refrigerant condenser, via a refrigerant gas pipe 141. The fourth heat exchanger 35 has a port defined in a lower portion thereof for removing a refrigerant liquid condensed in the fourth heat exchanger 35, and the port is connected to a fifth heat exchanger 25, which is a refrigerant evaporator, via a refrigerant pipe 142, which has an expansion valve 7 as a throttle. The fifth heat exchanger 25 has a port defined in an upper portion thereof for removing a refrigerant gas evaporated in the fifth heat exchanger 25, and the port is connected to an inlet port of the compressor 3 via a refrigerant gas pipe 144. Typically, the fifth heat exchanger 25 is disposed vertically upwardly of the fourth heat exchanger 35.

As shown in FIG. 8, the fourth heat exchanger 35 has a shell-and-tube structure, for example. The refrigerant, which is a working medium of the heat pump HP, flows and is condensed in a tube 147, and the heating medium in a liquid phase contacts the outer surface of the tube in the shell and is evaporated. The shell has a heating medium supply port 42 defined in an upper portion thereof for supplying the heating medium in a vapor phase from the heat pump HP to an external device, and a heating medium return port 43 defined in its bottom for returning the heating medium in the liquid phase from an external device to the heat pump HP. A heating medium pipe 151 is connected to the heating medium supply port 42, and a heating medium pipe 152 is connected to the heating medium return port 43.

The fifth heat exchanger 25 also has a shell-and-tube structure, for example. The refrigerant, which is a working medium of the heat pump HP, flows and is evaporated in a tube 148, and the heating medium contacts the outer surface of the tube in the shell and is evaporated. The shell has a chilling medium supply port 40 defined in a lower portion thereof for supplying the chilling medium in a liquid phase from the heat pump HP to an external device, and a chilling medium return port 41 defined in an upper portion thereof for returning the chilling medium in a vapor phase from an external device to the heat pump HP. A chilling medium pipe 161 is connected to the chilling medium supply port 40, and a chilling medium pipe 162 is connected to the chilling medium return port 41.

The refrigerant gas heated and evaporated in the fifth heat exchanger 25 by the chilling medium in the vapor phase from the chilling medium return port 41 is drawn into the compressor 3, compressed thereby, and discharged into the fourth heat exchanger 35. The chilling medium cooled and condensed by the evaporation of the refrigerant in the fifth heat exchanger 25 is supplied from the chilling medium supply port 40 to the external device.

The refrigerant liquid cooled and condensed in the fourth heat exchanger 35 by the evaporation of the heating medium in the liquid phase from the heating medium return port 43 is depressurized by the throttle 7 and supplied to the fifth heat exchanger 25. The heating medium in the liquid phase heated by the condensation of the refrigerant in the fourth heat exchanger 35 is changed into the vapor phase and supplied from the heating medium supply port 42 to the external device. A subcooler 36 for exchanging heat between the condensed refrigerant liquid from the fourth heat exchanger 35 and the heating medium in the liquid phase returning to the fourth heat exchanger to supercool the refrigerant liquid is disposed adjacent to the fourth heat exchanger 35.

Figure 9:
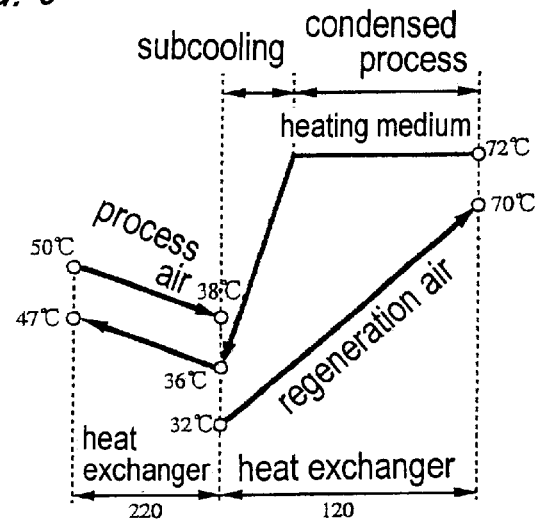
FIG. 9 is a diagram illustrative of a heat exchange between a heating medium and process air and between a heating medium and regeneration air with respect to the embodiment taken into consideration in FIG. 3.

The relationship between the temperature and humidity of the air in the air-conditioning unit shown in FIG. 1 of the dehumidifying air-conditioning apparatus with the above heat pump is the same as the relationship described above with reference to FIG. 3, and will not be described below. Operation of the heat exchanger 120 and the heat exchanger 220 in the dehumidifying air-conditioning apparatus with the heat pump shown in FIG. 8 will be described below with reference to FIG. 9 and FIG. 3.

The heating medium that has been condensed into a liquid at a saturation temperature of about 72° C. in the heat exchanger 120 is supercooled to about 36° C. The heating medium of 36° C. increases its temperature to about 47° C. while cooling the process air, as described above. This process represents a heat recovery for the heating medium. The heating medium which has gained the recovered heat is returned in the liquid phase to the heat pump HP (FIG. 8). In the heat pump HP, the heating medium is heated and evaporated in the fourth heat exchanger 35, and supplied in a vapor phase at about 72° C. to the heat exchanger 120, as described above, where the heating medium heats the regeneration air. As described above, the regeneration air is heated from about 32° C. to about 70° C. Of the temperature increase, an increase from a state Q at about 32° C. up to a state R at about 46° C. represents the recovery of heat from the process air by the heat exchanger 220, as shown in FIG. 3.

In the heat exchanger 120, the heating medium of about 72° C. and the outdoor air of about 32° C. used as the regeneration air exchange heat with each other while flowing in opposite directions. The heating medium is first in the vapor phase, and condensed in the state at about 72° C. The heating medium which has been changed into the liquid phase by the condensation is supercooled from about 72° C. to about 36° C. At this time, the regeneration air which exchanges heat with the heating medium increases its temperature from about 32° C. to about 70° C.

As described above, the heating medium which has been supercooled to about 36° C. and the process air exchange heat with each other while flowing in opposite directions in the heat exchanger 220. The heating medium is heated from about 36° C. to about 47° C. At this time, the process air which exchanges heat with the heating medium lowers its temperature from about 50° C. to about 38° C.

The above process may be carried out in a centralized fashion by one dehumidifying air-conditioning apparatus shared by a plurality of air-conditioned spaces 61A through 61E. Typically, however, the above process is carried out by individual dehumidifying air-conditioning apparatus associated respectively with the air-conditioned spaces.

The refrigerant cycle of the heat pump HP in this embodiment is the same as the refrigerant cycle described above with reference to FIG. 5, and will not be described below. In this embodiment, the cooling effect is also increased by about 37% as compared with the conventional example represented by the Mollier diagram of FIG. 17.

Figure 10:
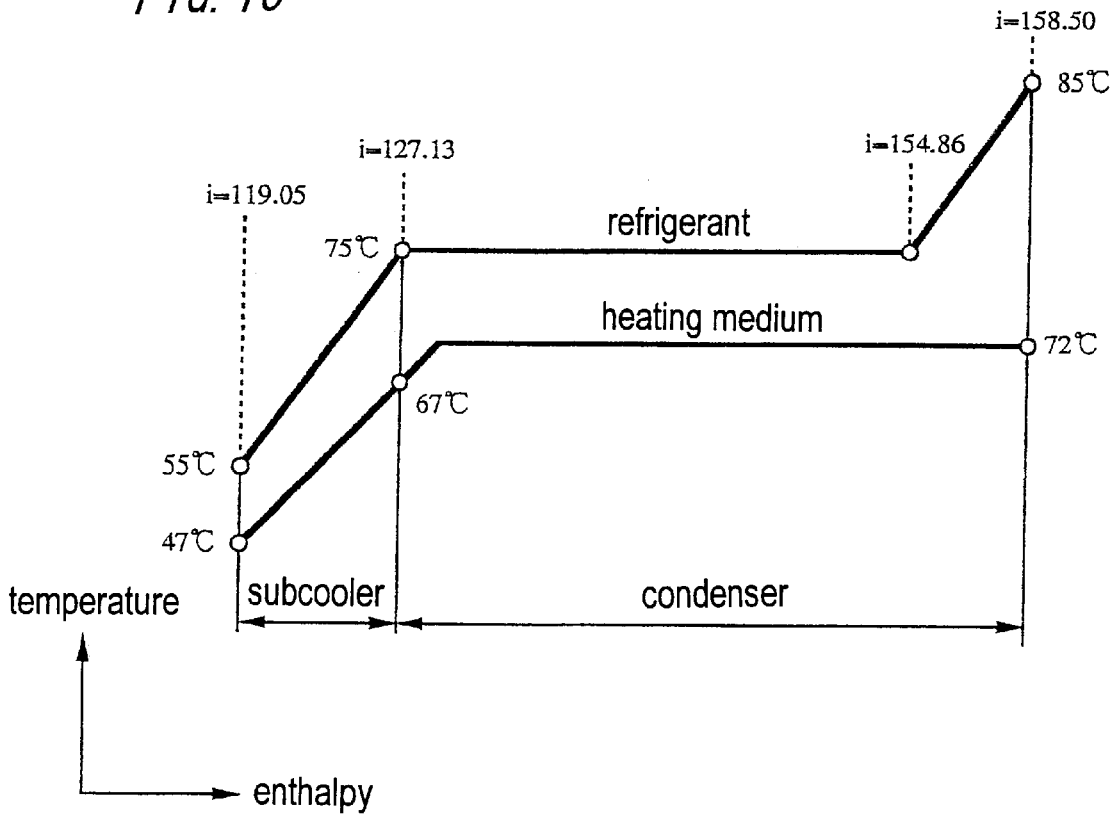
FIG. 10 is a diagram illustrative of a heat exchange between a refrigerant and a heating medium with respect to the embodiment taken into consideration in FIG. 3.

Temperature changes with respect to enthalpy changes of the refrigerant and the heating medium in the fourth heat exchanger 35 in this example will be described below with reference to FIG. 10 and FIG. 5. First, changes in the enthalpy and temperature of the refrigerant will be described below. In FIG. 10, the refrigerant is supplied in a superheated state represented by the point b in FIG. 5 (the temperature is about 85° C. and the enthalpy is about 158.50 kcal/kg) to the fourth heat exchanger 35. The refrigerant gas is cooled by the heating medium into a saturated gas at the point c shown in FIG. 5 (the temperature is about 75° C. and the enthalpy is about 154.86 kcal/kg). From this state, heat is removed from the refrigerant gas to change the enthalpy from about 154.86 kcal/kg to about 127.13 kcal/kg while the temperature is being kept constant at 75° C. In FIG. 5, the refrigerant is in the form of a saturated liquid at the point d. The refrigerant is further supercooled to about 55° C. by the heating medium, and reaches a state represented by the point e shown in FIG. 5.

While the refrigerant is thus changing its state, the heating medium which flows in a direction opposite to the refrigerant is supplied at about 47° C. to the subcooler 36, and starts exchanging heat with the refrigerant at a point corresponding to the point e. At a point corresponding to a point intermediate between the point e and the point d of the refrigerant (actually considerably close to the point d), the heating medium is heated to about 67° C. The heating medium is discharged from the subcooler 36 and delivered to the fourth heat exchanger (condenser) 35, and exchanges heat toward a point corresponding to the point d of the refrigerant. The heating medium increases its temperature up to about 72° C., and starts being evaporated. In this manner, the heating medium is evaporated.

The heating medium is supplied in the vapor phase from the fourth heat exchanger 35 as the condenser of the heat pump HP to the dehumidifying air-conditioning apparatus, and returned in the liquid phase from the dehumidifying air-conditioning apparatus. Therefore, the amount of the heating medium that flows to transfer the same amount of heat may be small. With the fourth heat exchanger 35 disposed vertically below the dehumidifying air-conditioning apparatus, the heating medium in the liquid phase is returned to the fourth heat exchanger 35 by gravity, and the heating medium in the vapor phase is supplied from the fourth heat exchanger 35 to the dehumidifying air-conditioning apparatus under a slight pressure difference. Consequently, since the heating medium flows spontaneously due to the action of the gravity, the power to transfer the heat may be extremely small. The diameter of the pipe 152 for passing the heating medium in the liquid phase therethrough may be reduced, so that the pipe 152 can be installed with ease.

In this embodiment, since the second heat exchanger 220 as the heat exchanger for the heating medium is also disposed in the process air system, the apparatus can be operated in a heating operation mode. In the heating operation mode, the supply of the regeneration air is stopped. Specifically, the blower 140, for example, may be shut off. Outdoor air may be used as a low temperature heat source for the heat pump, for example. In order to use outdoor air, the heat of outdoor air may be introduced into the fifth heat exchanger 25 using a heat exchanger (not shown) for the low temperature heat source. Alternatively, a heat exchanger (not shown) for the high temperature heat source may be provided in the fourth heat exchanger 35 for heating the heating medium.

The chilling medium is supplied in the liquid phase from the fifth heat exchanger 25 as the evaporator of the heat pump HP to the dehumidifying air-conditioning apparatus, and returned in the vapor phase from the dehumidifying air-conditioning apparatus. Therefore, the amount of the chilling medium that flows to transfer the same amount of heat may be small. With the fifth heat exchanger 25 disposed vertically above the dehumidifying air-conditioning apparatus, the chilling medium in the liquid phase is supplied from the fifth heat exchanger 25 to the dehumidifying air-conditioning apparatus by gravity, and the chilling medium in the vapor phase evaporated by the dehumidifying air-conditioning apparatus is returned to the fifth heat exchanger 25 under a slight pressure difference. Consequently, since the chilling medium flows spontaneously due to the action of the gravity, the power to transfer the heat may be extremely small. The diameter of the pipe 161 for passing the chilling medium in the liquid phase therethrough may be reduced, so that the pipe 161 can be installed with ease.

Figure 11:
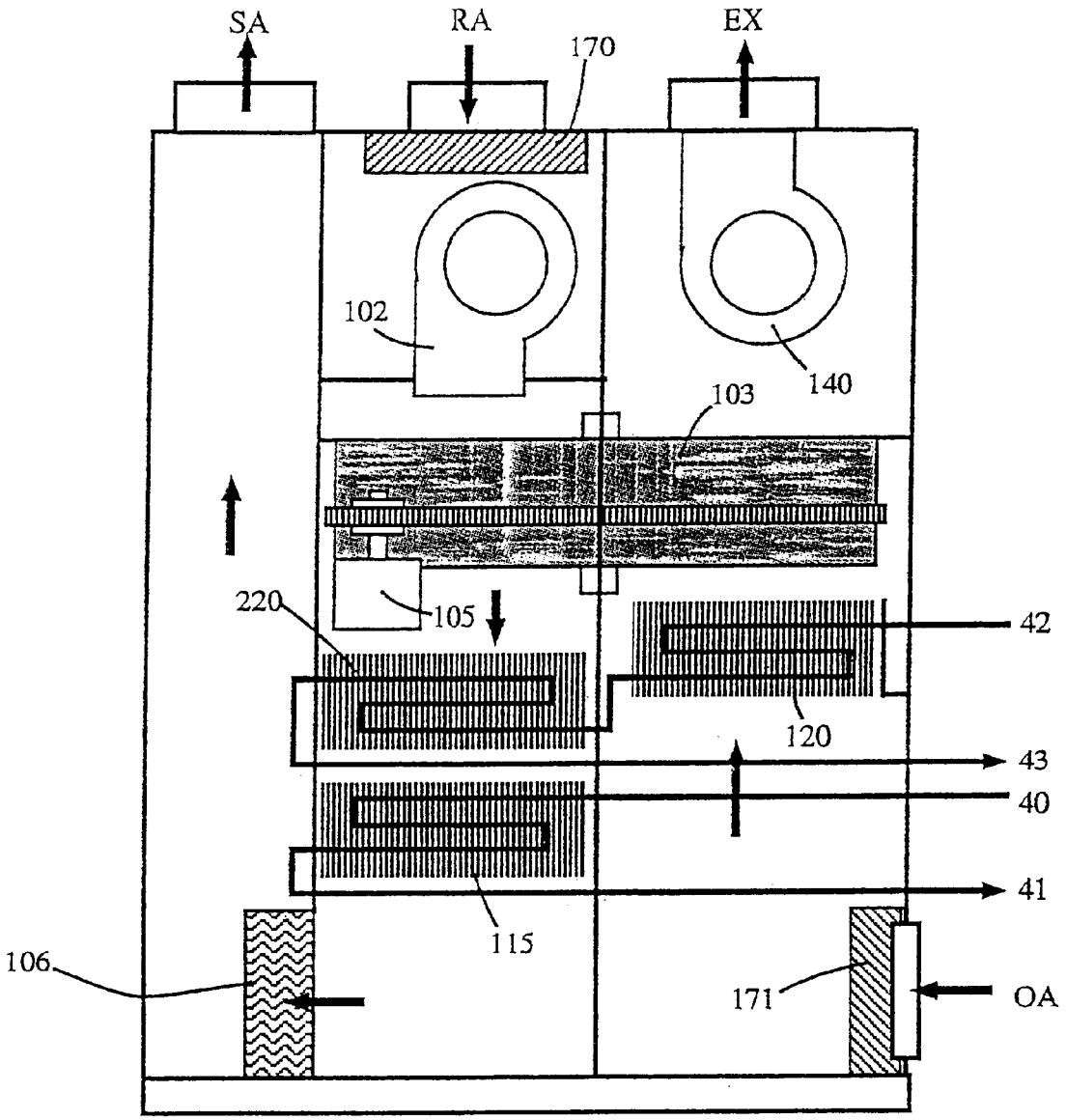
FIG. 11 is a schematic cross-sectional front view showing an actual structure of a dehumidifying air-conditioning apparatus according to a second embodiment of the present invention.

FIG. 11 shows a mechanical arrangement of the dehumidifying air-conditioning apparatus described above. The mechanical arrangement will not be described below because it is not substantially different from the mechanical arrangement of the first embodiment shown in FIG. 7. In this embodiment, the dehumidifying air-conditioning apparatus is also compact as it does not need the rotary or cross-flow type sensible heat exchanger 104 (FIG. 16) which has been used in the conventional apparatus.

A dehumidifying air-conditioning apparatus according to a third embodiment of the present invention will be described below with reference to a flow diagram shown in FIG. 12. The dehumidifying air-conditioning apparatus differs from the dehumidifying air-conditioning apparatus according to the first or second embodiment in that a switching valve is disposed in the path for the heating medium to allow the dehumidifying air-conditioning apparatus to operate easily in a dehumidifying mode. The heat pump shown in either FIG. 2 or FIG. 8 may be used.

Figure 12:
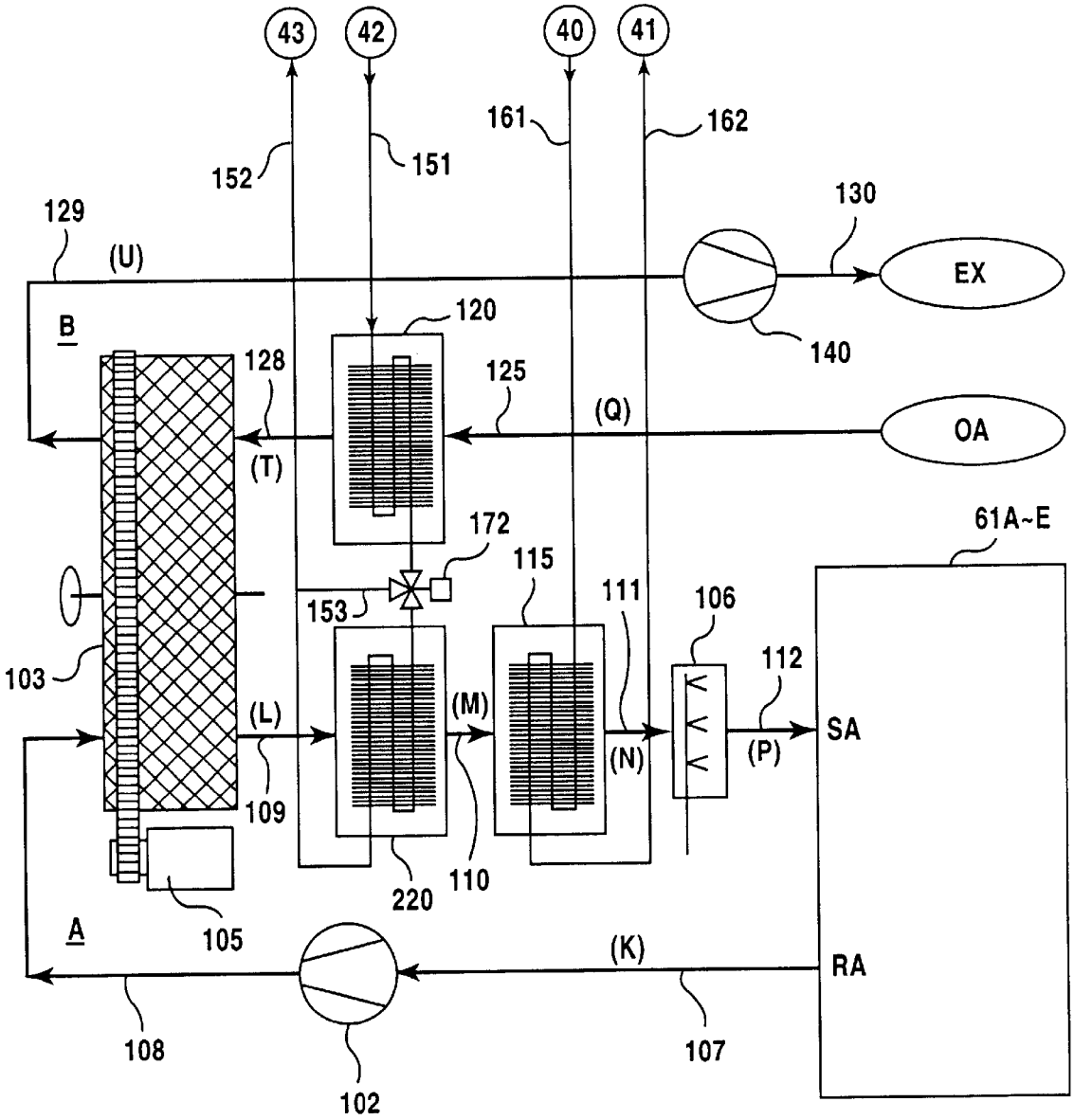
FIG. 12 is a flow diagram of a dehumidifying air-conditioning apparatus according to a third embodiment of the present invention.

As shown in FIG. 12, a three-way valve 172 is disposed in the heating medium path between the heating medium outlet port of the heat exchanger 120 and the heating medium inlet port of the heat exchanger 220. The three-way valve 172 has a third port connected to a path 153 that is joined to a path 152. For operating the apparatus in a cooling mode, the three-way valve 172 is shifted to close the path 153 for thereby directing all the heating medium that has passed through the heat exchanger 120 to be delivered into the heat exchanger 220, as with the first embodiment.

For operating the apparatus in the dehumidifying mode, the three-way valve 172 is shifted to direct the heating medium that has passed through the heat exchanger 120 to bypass the heat exchanger 220 and to flow via the path 153 into the path 152 and then to the heating medium return port 43 of the heat pump. At this time, the heat of the heating medium is used only to heat the regeneration air in the heat exchanger 120. The process air is not cooled in the heat exchanger 220, but is only cooled by the chilling medium in the heat exchanger 115. In the dehumidifying mode, the humidifier 106 is also shut off.

Figure 13:
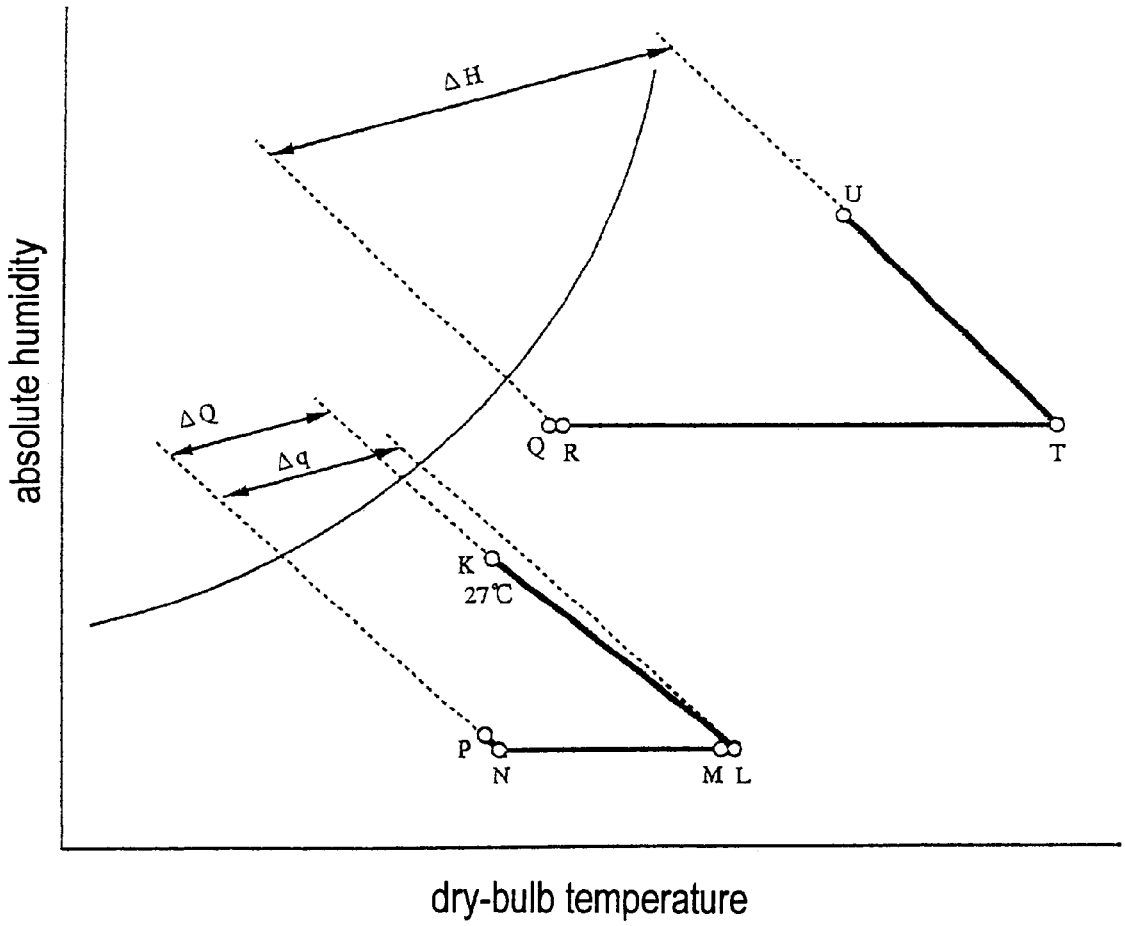
FIG. 13 is a psychrometric chart illustrative of operation of the dehumidifying air-conditioning apparatus shown in FIG. 12.

The above operation will be described below with reference to a psychrometric chart shown in FIG. 13. In FIG. 13, alphabetical letters K through N, and P, Q, R, T and U represent states of air in various regions, and correspond to the alphabetical letters which are encircled in the flow diagram of FIG. 12.

First, a flow of process air A will be described below. In FIG. 13, process air (in a state K) at about 27° C. from the air-conditioned spaces 61A through 61E is delivered to the desiccant wheel 103 as a moisture adsorption device. In the desiccant wheel 103, the desiccant adsorbs moisture from the process air to lower the absolute humidity thereof, and the dry-bulb temperature is increased by the heat of adsorption in the desiccant, so that the process air reaches a state L. The air is then delivered to the second heat exchanger 220. Since the heating medium does not flow in the second heat exchanger 220, the process air passes unchanged through the second heat exchanger 220 (a state M which is shown as being close to the state L for easy understanding, but is actually superposed on the state L), and is delivered into the third heat exchanger 115. In the third heat exchanger 115, the air is cooled into air in a state N while its absolute humidity is being kept constant. Since the humidifier 106 is shut off, the air in the state N is supplied to the air-conditioned spaces 61A through 61E. In FIG. 13, a point in a state P is shown as being close to the state N for easy understanding, but is actually superposed on the state N. The air in the state N has its dry-bulb temperature substantially equal to the dry-bulb temperature of the air in the state K, and its absolute humidity lower than the absolute humidity of the air in the state K.

In the above description, the three-way valve is shifted to direct the entire amount of the heating medium to be supplied to the heat exchanger 220 or to bypass the heat exchanger 220. However, the three-way valve may be arranged to direct a portion of the heating medium to bypass the heat exchanger 220. In this case, since the degree by which the process air is cooled and the degree by which the regeneration air is heated can be adjusted, the temperature in the state N can freely be set or adjusted.

Figure 14:
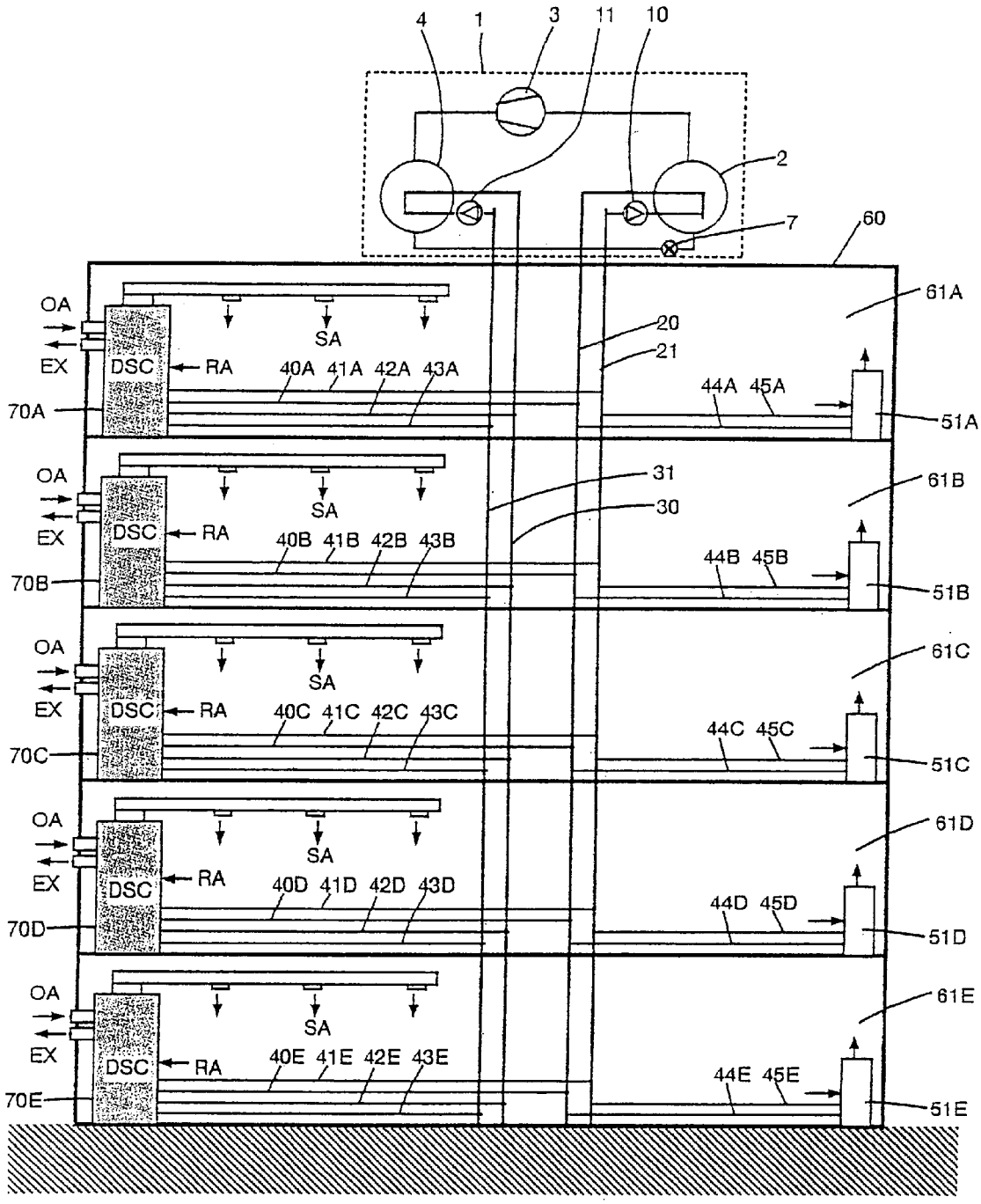
FIG. 14 is a flow diagram of a dehumidifying air-conditioning system according to an embodiment of the present invention.

An embodiment of a dehumidifying air-conditioning system in which the dehumidifying air-conditioning apparatus shown in FIG. 1 or FIG. 12 that employs the heat pump shown in FIG. 2 is used for air-conditioning a building will be described below with reference to FIG. 14. In FIG. 14, a heat pump 1 is mounted on the roof of a building 60. The heat pump 1 comprises an evaporator 2, a compressor 3 for drawing and compressing a refrigerant gas evaporated in the evaporator 2, a condenser 4 for condensing the refrigerant gas discharged from the compressor 3, and an expansion valve 7 for depressurizing the condensed refrigerant liquid and returning the refrigerant liquid to the evaporator 2. These devices are connected by refrigerant gas pipes or refrigerant liquid pipes.

To the evaporator 2, there are connected cold water pipes (a cold water pipe 21 for cold water to be cooled and a cold water pipe 20 for cooled cold water) as pipes for chilling medium cooled by the evaporation of the refrigerant, and the pipe 21 has a cold water circulation pump 10. To the condenser 4, there are connected hot water pipes (a hot water pipe 31 for hot water to be heated and a hot water pipe 30 for heated hot water) as pipes for heating medium heated by the condensation of the refrigerant, and the hot water pipe 31 has a hot water circulation pump 11. The cold water pipes 20, 21 and the hot water pipes 30, 31 start from the heat pump 1 and extend from an air-conditioned space 61A on the uppermost floor to an air-conditioned space 61E on the lowermost floor (while a five-story building having floors A through E is shown in FIG. 14, the application of the dehumidifying air-conditioning system is not limited to such a building).

Dehumidifying air-conditioning apparatus (DSC) 70A, 70B, 70C, 70D and 70E, each identical to the dehumidifying air-conditioning apparatus shown in FIG. 1, are installed in respective regions where a latent load is large, e.g., northern spaces or cores on the respective floors. The dehumidifying air-conditioning apparatus 70A has an inlet port for introducing outdoor air OA and an outlet port for discharge air EX, and a process air duct for supplying supply air (SA) that has been processed into an air-conditioned space is connected to the dehumidifying air-conditioning apparatus 70A. To the dehumidifying air-conditioning apparatus 70A, there are also connected a branch pipe 40A extending from the cold water pipe 20, a branch pipe 41A extending from the cold water pipe 21, a branch pipe 42A extending from the hot water pipe 30, and a branch pipe 43A extending from the hot water pipe 31. The dehumidifying air-conditioning apparatus 70B, 70C, 70D and 70E on the other floors are similarly arranged.

Fan coil units 51A, 51B, 51C, 51D and 51E are installed in respective regions (perimeters) where a sensible load is large, e.g., southern window-side spaces on the respective floors. To the fan coil unit 51A, there are connected a branch pipe 44A extending from the cold water pipe 20 and a branch pipe 45A extending from the cold water pipe 21. The fan coil units 51B, 51C, 51D and 51E on the other floors are similarly arranged.

In the air-conditioning system of the above construction, a latent load is processed for achieving a dehumidifying effect of a cooling load by the desiccant air-conditioning units 70A through 70E, and a sensible load such as sunlight radiation in perimeter regions is processed by the fan coil units 51A through 51E. In the conventional cooling process, since the sensible load is also processed by cold water, it has been necessary to cool air to a temperature equal to or lower than the dew point, and it has been customary to supply cold water at a temperature in a range from 5 to 7° C. to meet such a requirement. According to the present system, however, since cold water needs to process only the sensible load, it is sufficient for the temperature of cold water to be about 10° C. lower than the air temperature, and hence cold water at a temperature ranging from 10 to 15° C. is circulated. In the desiccant air-conditioning units, since the regeneration air at a temperature ranging from 60 to 80° C. is required to regenerate the desiccant, hot water at a temperature ranging from 70 to 90° C. is circulated to meet such a requirement.

In this embodiment, hot water at about 75° C., for example, is supplied as the heating medium to the desiccant air-conditioning units, and returned at 47° C. from the desiccant air-conditioning units to the heat pump. In this case, the temperature difference that is used is 28° C. Since the temperature difference is large, the amount of circulated hot water may be small. Accordingly, the diameters of the hot water pipes 30, 31 and the branch pipes 41A through 43E of the hot water pipes may be small, and the power required to operate the hot water pump 11 may be small.

Figure 15:
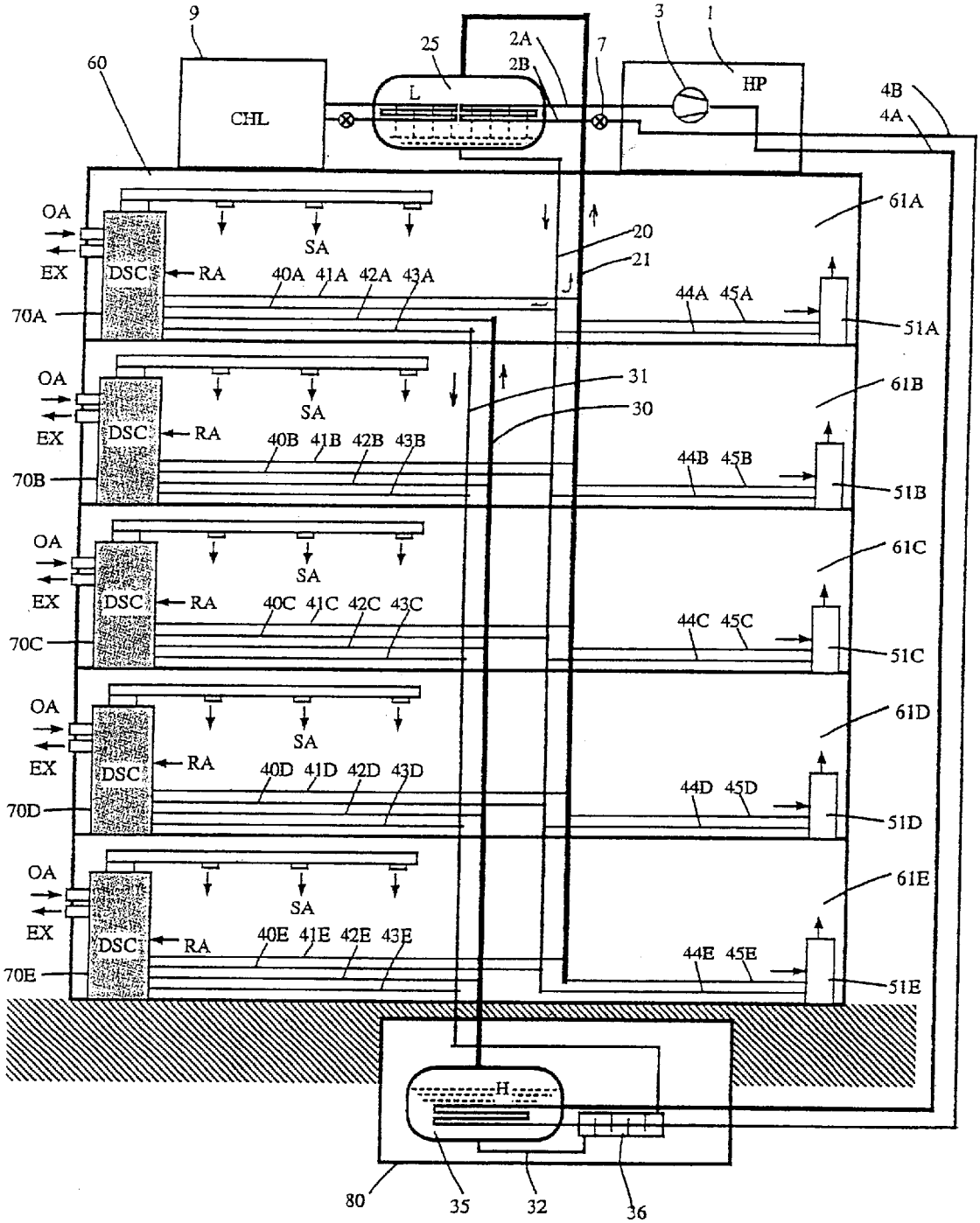
FIG. 15 is a flow diagram of a dehumidifying air-conditioning system according to an embodiment of the present invention.

An embodiment of a dehumidifying air-conditioning system in which the dehumidifying air-conditioning apparatus shown in FIG. 1 or FIG. 12 that employs the heat pump shown in FIG. 8 is used for cooling a building will be described below with reference to FIG. 15. In FIG. 15, a heat pump (HP) 1 is mounted on the roof of a building 60. The heat pump 1 comprises a fifth heat exchanger 25 as an evaporator for evaporating a refrigerant as a working medium, a compressor 3 for drawing and compressing the refrigerant gas evaporated in the fifth heat exchanger 3, a fourth heat exchanger 35 as a condenser for condensing the refrigerant gas discharged from the compressor 3, and an expansion valve 7 for depressurizing the condensed refrigerant liquid and returning the refrigerant liquid to the evaporator 25. A subcooler 36 for supercooling the refrigerant is disposed adjacent to the condenser 35. These devices are connected by refrigerant gas pipes or refrigerant liquid pipes.

To the evaporator 25, there are connected chilling medium pipes (a vapor phase pipe 21 and a liquid phase pipe 20) for a chilling medium from which heat is removed by the evaporation of the refrigerant. To the condenser 35, there are connected heating medium pipes (a liquid phase pipe 31 for a liquid phase to be heated and a vapor phase pipe 30 for a heated liquid phase) for a heating medium that is heated by the condensation of the refrigerant. The chilling medium pipes 20, 21 and the heating medium pipes 30, 31 extend from an air-conditioned space 61A on the uppermost floor to an air-conditioned space 61E on the lowermost floor (while a five-story building having floors A through E is shown in FIG. 15, the application of the dehumidifying air-conditioning system is not limited to such a building).

Dehumidifying air-conditioning apparatus (DSC) 70A, 70B, 70C, 70D and 70E, each identical to the dehumidifying air-conditioning apparatus described with reference to FIG. 12, are installed in respective regions where a latent load is large, e.g., northern spaces or cores on the respective floors. The dehumidifying air-conditioning apparatus 70A has an inlet port for introducing outdoor air OA and an outlet port for discharge air EX, and a process air duct for supplying supply air (SA) that has been processed into an air-conditioned space is connected to the dehumidifying air-conditioning apparatus 70A. To the dehumidifying air-conditioning apparatus 70A, there are also connected a branch pipe 40A extending from the chilling medium pipe 20, a branch pipe 41A extending from the chilling medium pipe 21, a branch pipe 42A extending from the heating medium pipe 30, and a branch pipe 43A extending from the heating medium pipe 31. The dehumidifying air-conditioning apparatus 70B, 70C, 70D and 70E on the other floors are similarly arranged. The branch pipe 40A corresponds to the pipe 161 shown in FIG. 12, the branch pipe 41A to the pipe 162, the branch pipe 42A to the pipe 151, and the branch pipe 43A to the pipe 152.

Fan coil units 51A, 51B, 51C, 51D and 51E are installed in respective regions (perimeters) where a sensible load is large, e.g., southern window-side spaces on the respective floors. To the fan coil unit 51A, there are connected a branch pipe 44A extending from the chilling medium pipe 20 and a branch pipe 45A extending from the chilling medium pipe 21. The fan coil units 51B, 51C, 51D and 51E on the other floors are similarly arranged.

In the air-conditioning system of the above construction, a latent load is processed for achieving a dehumidifying effect of a cooling load by the desiccant air-conditioning units 70A through 70E, and a sensible load such as sunlight radiation in perimeter regions is processed by the fan coil units 51A through 51E. In the conventional cooling process, since the sensible load is also processed by cold water, it has been necessary to cool air to a temperature equal to or lower than the dew point, and it has been customary to supply cold water at a temperature in a range from 5 to 7° C. to meet such a requirement. According to the present system, however, since cold water needs to process only the sensible load, it is sufficient for the temperature of cold water to be about 10° C. lower than the air temperature. In the desiccant air-conditioning units, since the regeneration air at a temperature ranging from 60 to 80° C. is required to regenerate the desiccant, a heating medium at a temperature ranging from 70 to 90° C. is circulated to meet such a requirement.

In the dehumidifying air-conditioning system according to this embodiment, since the fifth heat exchanger 25 as an evaporator for the refrigerant and a condenser for the chilling medium in the heat pump 1 is mounted on the roof of the building, the chilling medium in a liquid phase at a low temperature is supplied by natural convection under gravity to the dehumidifying air-conditioning apparatus 70A through 70E or the fan coil units 51A through 51E. The chilling medium heated into a vapor phase is returned to the fifth heat exchanger 25 by natural convection under gravity.

In this embodiment, the chilling medium is supplied to each of the dehumidifying air-conditioning apparatus 70A through 70E and the fan coil units 51A through 51E. The dehumidifying air-conditioning apparatus and the fan coil units are equipped with traps, for example, so as not to be supplied with an excessive chilling medium in a liquid phase.

Inasmuch as the fourth heat exchanger 35 as a condenser for the refrigerant and an evaporator for the heating medium in the heat pump 1 is mounted underground below the building, the heating medium in a vapor phase at a high temperature is supplied by natural convection under gravity to the dehumidifying air-conditioning apparatus 70A through 70E. The heating medium whose temperature is lowered and which is changed into the liquid phase is returned by natural convection under gravity to the fourth heat exchanger 35.

Since the system needs no pump for delivering the heating medium and no compressor for the heating medium, or since any pump for delivering the heating medium may be a low-head pump disposed in the liquid phase line, the power to transfer the heat may be extremely small.

In the embodiment shown in FIG. 15, the system has a chilling machine 9 connected to the fifth heat exchanger 25 for removing heat from the chilling medium in the fifth heat exchanger 25. The chilling machine 9 comprises a compression-type chilling machine having an evaporator which comprises a heat exchange tube L incorporated in the fifth heat exchanger 25. When a cooling load on the building increases and cannot be covered by only the heat pumping capacity of the heat pump 1, the chilling machine 9 is operated to assist in cooling and condensing the chilling medium. The chilling machine 9 is not limited to a compression-type chilling machine, but may be an absorption-type chilling machine.

A high temperature heat source (not shown) may be provided in the fourth heat exchanger 35. The high temperature heat source comprises a heat exchange tube separately incorporated in the fourth heat exchanger 35. When the system is operated in the heating mode or needs to be operated in the dehumidifying mode due to an increased latent load, and a heating load or a dehumidifying load cannot be covered by only the heat pumping capacity of the heat pump 1, the high temperature heat source is operated to assist in cooling and condensing the heating medium.

In the embodiments described above, a refrigerant for use in a chilling machine may be used as the heating medium or the chilling medium. Since the heating medium system and the chilling medium system are separated from each other, different media may be used. The heating medium and the chilling medium may be the same as or different from the refrigerant used in the heat pump 1. For air-conditioning ordinary buildings, a medium suitable for use as the heating medium is HFC134*a* or HFC245*ca,* for example, and a medium suitable for use as the chilling medium is HFC407C, HFC410A, or HFC134*a*.

According to the present invention, as described above, since the heating medium supplied from a heating medium supply device flows through the first heat exchanger and the second heat exchanger in the order named. Therefore, heat equivalent to a portion of heat used to heat the regeneration air in the first heat exchanger can be recovered from the process air in the second heat exchanger. Consequently, it is possible to provide a compact dehumidifying air-conditioning apparatus, and a dehumidifying air-conditioning system with a reduced power for delivering the heating medium. Since the heat is transferred using phase changes of the heating medium, it is possible to provide a dehumidifying air-conditioning system where the power to transfer the heat is extremely small.

Industrial Applicability

The present invention is useful for as an energy-saving dehumidifying air-conditioning apparatus and an energy-saving dehumidifying air-conditioning system for air-conditioning a building.

What is claimed is:

1. A dehumidifying air-conditioning apparatus comprising:

a moisture adsorption device having a desiccant for adsorbing moisture from process air, adsorbed moisture being desorbed by regeneration air;

a first heat exchanger for exchanging heat between said regeneration air and a heating medium, said first heat exchanger being disposed upstream of said moisture adsorption device with respect to a flow of said regeneration air;

a second heat exchanger for exchanging heat between said process air and the heating medium, said second heat exchanger being disposed downstream of said moisture adsorption device with respect to a flow of said process air; and a heating medium supply device for heating the heating medium supplied to said first heat exchanger and said second heat exchanger;

wherein the arrangement is such that said heating medium supplied from said heating medium supply device flows through said first heat exchanger and said second heat exchanger in the order named.

2. A dehumidifying air-conditioning apparatus according to claim 1, further comprising a third heat exchanger for exchanging heat between said process air and a chilling medium, said third heat exchanger being disposed downstream of said second heat exchanger with respect to the flow of said process air.

3. A dehumidifying air-conditioning apparatus according to claim 2, wherein said heating medium supply device is arranged to supply said chilling medium, and comprises a heat pump for pumping heat from said chilling medium to said heating medium.

4. A dehumidifying air-conditioning apparatus according to claim 2 or 3, wherein the difference between the temperature of said chilling medium at an inlet of said third heat exchanger and the temperature of said chilling medium at an outlet of said third heat exchanger is 10° C. or less.

5. A dehumidifying air-conditioning apparatus according to any one of claims 1 through 3, wherein the difference between the temperature of said heating medium at an inlet of said first heat exchanger and the temperature of said heating medium at an outlet of said second heat exchanger is 15-C or more.

6. A dehumidifying air-conditioning system comprising:

a dehumidifying air-conditioning apparatus according to any one of claims 2 through 5;

a heating medium pipe for supplying said heating medium from said heating medium supply device to said first heat exchanger and said second heat exchanger; and a chilling medium pipe for supplying said chilling medium from said heating medium supply device to said third heat exchanger.

7. A dehumidifying air-conditioning apparatus comprising:

a moisture adsorption device having a desiccant for adsorbing moisture from process air, adsorbed moisture being desorbed by regeneration air;

a first heat exchanger for exchanging heat between said regeneration air and a heating medium in a vapor phase, said first heat exchanger being disposed upstream of said moisture adsorption device with respect to a flow of said regeneration air; and a second heat exchanger for exchanging heat between said process air and the heating medium which has exchanged heat in said first heat exchanger, said second heat exchanger being disposed downstream of said moisture adsorption device with respect to a flow of said process air.

8. A dehumidifying air-conditioning apparatus according to claim 7, further comprising a third heat exchanger for exchanging heat between said process air and a chilling medium in a liquid phase, said third heat exchanger being disposed downstream of said second heat exchanger with respect to the flow of said process air.

9. A dehumidifying air-conditioning apparatus according to claim 7 or 8, further comprising a switching device disposed between said first heat exchanger and said second heat exchanger for changing a flow of said heating medium which has exchanged heat in said first heat exchanger.

10. A dehumidifying air-conditioning system comprising:

a dehumidifying air-conditioning apparatus according to claim 8; and a heat pump for pumping heat from the chilling medium supplied to said third heat exchanger to the heating medium supplied to said first heat exchanger.

11. A dehumidifying air-conditioning system according to claim 10, comprising a plurality of said dehumidifying air-conditioning apparatus for one said heat pump.

12. A dehumidifying air-conditioning system according to claim 10 or 11, wherein said heat pump comprises:

a fourth heat exchanger for imparting heat to said heating medium; and a fifth heat exchanger for removing heat from said chilling medium.

13. A dehumidifying air-conditioning system according to claim 12, wherein said fourth heat exchanger is disposed relatively vertically downwardly of said dehumidifying air-conditioning apparatus, and said fifth heat exchanger is disposed relatively vertically upwardly of said dehumidifying air-conditioning apparatus.

14. A dehumidifying air-conditioning system according to claim 10 or 11, further comprising a chilling machine for removing heat from said chilling medium.

* * * * *